US012434115B2

(12) United States Patent
Taylor et al.

(10) Patent No.: US 12,434,115 B2
(45) Date of Patent: Oct. 7, 2025

(54) IRON-TYPE GOLF CLUB HEAD

(71) Applicant: Taylor Made Golf Company, Inc, Carlsbad, CA (US)

(72) Inventors: Scott Taylor, Bonita, CA (US); Connor Halberg, San Clemente, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 480 days.

(21) Appl. No.: 18/087,989

(22) Filed: Dec. 23, 2022

(65) Prior Publication Data

US 2023/0131767 A1 Apr. 27, 2023

Related U.S. Application Data

(63) Continuation-in-part of application No. 17/566,131, filed on Dec. 30, 2021, which is a continuation-in-part of application No. 17/368,520, filed on Jul. 6, 2021, now Pat. No. 11,458,374, which is a continuation-in-part of application No. 17/330,033, filed on May 25, 2021, now Pat. No. 11,413,510, which is a continuation-in-part of application No. 17/132,541, filed on Dec. 23, 2020, (Continued)

(51) Int. Cl.
*A63B 53/04* (2015.01)
*A63B 60/54* (2015.01)

(52) U.S. Cl.
CPC ..... *A63B 53/0475* (2013.01); *A63B 53/0408* (2020.08); *A63B 53/0433* (2020.08); *A63B 60/54* (2015.10)

(58) Field of Classification Search
CPC ..... A63B 53/047
See application file for complete search history.

(56) References Cited

U.S. PATENT DOCUMENTS 5,011,151 A * 4/1991 Antonious ..... A63B 53/047 473/350
5,316,297 A * 5/1994 Chappell ..... A63B 60/00 473/291

(Continued)

FOREIGN PATENT DOCUMENTS

AU 652640 B2 * 9/1994 ..... A63B 53/04
AU 662700 B2 * 9/1995 ..... A63B 53/02

(Continued)

*Primary Examiner* — Alvin A Hunter
(74) *Attorney, Agent, or Firm* — Kunzler Bean & Adamson

(57) ABSTRACT

An iron-type golf club head where a ratio of a maximum toe height of the iron-type golf club head to a blade length of the iron-type golf club head is greater than zero and at most 0.62. A maximum thickness of the front portion, along the strike face, corresponds with a location toeward of a geometric center of the strike face. The thickness of the front portion, at the geometric center of the strike face, is less than the maximum thickness of the front portion. A coefficient of restitution (COR) of the iron-type golf club head is at least 0.818 and at most 0.830. An entirety of the sole is rounded along a plane parallel to the strike face, and a radius of curvature of the sole, along the plane parallel to the strike face, is no more than between, and inclusive of, 100 mm and 275 mm.

35 Claims, 7 Drawing Sheets

Related U.S. Application Data now Pat. No. 11,400,351, which is a continuation-in-part of application No. 16/870,714, filed on May 8, 2020, now Pat. No. 11,406,882.

(60) Provisional application No. 62/954,211, filed on Dec. 27, 2019, provisional application No. 62/846,492, filed on May 10, 2019.

(56) References Cited

U.S. PATENT DOCUMENTS 5,333,872 A * 8/1994 Manning ..... A63B 53/047 473/291
5,423,546 A * 6/1995 Manning ..... A63B 53/04 473/331
5,429,353 A * 7/1995 Hoeflich ..... A63B 60/00 473/291
6,997,820 B2 2/2006 Willet et al.
8,083,607 B2 * 12/2011 Clausen ..... A63B 53/04 473/291
8,795,102 B2 * 8/2014 Knight ..... A63B 60/00 473/350
9,427,635 B2 * 8/2016 Ines ..... A63B 53/047
9,597,562 B2 3/2017 Dipert et al.
9,718,119 B2 * 8/2017 Zimmerman ..... A63B 53/047
9,750,993 B2 * 9/2017 Ritchie ..... A63B 53/047
9,889,352 B2 * 2/2018 Ines ..... A63B 60/00
9,981,168 B2 * 5/2018 Ines ..... A63B 60/00
10,004,957 B2 * 6/2018 Franz ..... A63B 53/0475
10,010,772 B2 * 7/2018 Ines ..... A63B 60/02
10,052,534 B1 * 8/2018 Ines ..... A63B 60/02
10,357,697 B2 * 7/2019 Breier ..... A63B 53/047
10,478,681 B2 * 11/2019 Franz ..... A63B 53/0475
10,493,336 B2 * 12/2019 Taylor ..... A63B 60/00
10,617,919 B2 * 4/2020 Ines ..... A63B 60/02
10,881,926 B1 * 1/2021 Hill ..... A63B 60/02
11,007,410 B2 * 5/2021 Ines ..... A63B 53/0475
11,338,183 B2 * 5/2022 Taylor ..... A63B 53/02
11,406,882 B2 * 8/2022 Taylor ..... A63B 53/0408
2002/0193173 A1 * 12/2002 Sherwood ..... A63B 53/047 473/290
2012/0071259 A1 * 3/2012 Clausen ..... A63B 53/04 473/335
2012/0238376 A1 * 9/2012 Knight ..... A63B 60/00 473/349
2014/0228143 A1 * 8/2014 Roach ..... A63B 53/047 473/287
2015/0126301 A1 * 5/2015 Taylor ..... A63B 53/047 473/324
2015/0165281 A1 * 6/2015 Ines ..... A63B 53/047 473/291
2015/0217364 A1 * 8/2015 Zimmerman ..... A63B 53/047 72/352
2016/0243413 A1 * 8/2016 Ritchie ..... A63B 53/047
2016/0361609 A1 * 12/2016 Ines ..... A63B 53/047
2018/0117425 A1 * 5/2018 Taylor ..... A63B 60/52
2018/0243619 A1 * 8/2018 Ines ..... A63B 60/00
2018/0256947 A1 * 9/2018 Mata ..... A63B 53/0475
2020/0139207 A1 * 5/2020 Taylor ..... A63B 60/52
2021/0093933 A1 * 4/2021 Mata ..... A63B 53/047
2022/0331675 A1 * 10/2022 Halberg ..... A63B 53/0408
2023/0021981 A1 * 1/2023 Mata ..... A63B 53/047

FOREIGN PATENT DOCUMENTS

EP 0594414 B1 * 12/1997 ..... A63B 53/02
EP 2868353 A2 * 5/2015 ..... A63B 53/047
JP H06142233 A * 5/1994 ..... A63B 60/02
JP 2013043092 A * 3/2013 ..... B23K 26/364
JP 2015128580 A * 7/2015 ..... A63B 60/00
WO WO-02085462 A2 * 10/2002 ..... A63B 53/04

* cited by examiner

| Example | 1 | 2 | 3 | 4 | 5 | 6 | 7 | 8 | 9 |
|---|---|---|---|---|---|---|---|---|---|
| Loft (degrees) | 23.5 | 26.5 | 30 | 34 | 38.5 | 44.5 | 49 | 54 | 59 |
| Lie (degrees) | 62.5 | 63 | 63.5 | 64 | 64.5 | 65 | 65 | 65 | 65 |
| Topline Thickness (mm) | 7.6 | 7.6 | 7.6 | 7.6 | 7.6 | 7.6 | 7.6 | 7.6 | 7.6 |
| Face Area (mm^2) | 2466 | 2518 | 2567 | 2848 | 2973 | 3155 | 3253 | 3409 | 3392 |
| Blade Length (mm) | 83.1 | 83.1 | 82.9 | 81.8 | 81.4 | 80.3 | 80.3 | 80.3 | 80.1 |
| Maximum Toe Height (mm) | 45.6 | 45.4 | 44.8 | 47.1 | 47.8 | 47.3 | 45.8 | 43.7 | 39 |
| Face Length (mm) | 76.1 | 76.1 | 75.9 | 74.8 | 74.4 | 73.3 | 73.3 | 73.3 | 73.1 |
| Toe-GPIP Angle (degrees) | 34.4 | 34.3 | 33.9 | 36.4 | 37.4 | 37.6 | 36.8 | 36.9 | 33.8 |
| Blade Length/Face Height | 1.772 | 1.749 | 1.723 | 1.552 | 1.456 | 1.341 | 1.297 | 1.261 | 1.261 |
| Face height/Par Face Height | 1.498 | 1.489 | 1.480 | 1.541 | 1.570 | 1.610 | 1.620 | 1.625 | 1.628 |
| Face Height (mm) | 46.9 | 47.5 | 48.1 | 52.7 | 55.9 | 59.9 | 61.9 | 63.7 | 63.5 |
| Par Face Height (mm) | 31.3 | 31.9 | 32.5 | 34.2 | 35.6 | 37.2 | 38.2 | 39.2 | 39 |
| Sole Width, Toe (mm) | 32.6 | 32.7 | 32.8 | 33.5 | 32.3 | 31.8 | 31.8 | 32 | 32 |
| Sole Width, Mid (mm) | 31.1 | 31.4 | 31.4 | 31.1 | 30 | 29.3 | 29.2 | 29.6 | 29.9 |
| Sole Width, Heel (mm) | 22.8 | 23.3 | 23.8 | 23.4 | 22.9 | 22.6 | 22.7 | 23.1 | 23.3 |
| Leading Edge Height (mm) | 2.7 | 2.9 | 3.1 | 3.45 | 3.8 | 4.4 | 5 | 6.2 | 6.2 |
| Number of Grooves | 11 | 1 1 | 11 | 12 | 13 | 15 | 15 | 16 | 16 |
| Groove Length (mm) | 54.9 | 54.9 | 54.9 | 53.9 | 53 | 52.2 | 52.2 | 52.2 | 52.2 |
| Sole Radius (mm) | 125 | 125 | 125 | 125 | 125 | 125 | 125 | 125 | 125 |
| Bounce Angle (degrees) | 5.95 | 6.46 | 6.88 | 7.53 | 8.17 | 9.06 | 10.53 | 12.02 | 11.62 |
| Zup (mm) | 6.1 | 16.2 | 16.6 | 17.6 | 18.3 | 18.7 | 18.8 | 18.6 | 17.4 |
| CGx (mm) | 1.4 | 1.3 | 1 | 0.5 | 1 .6 | 2.3 | 2.7 | 3.9 | 4.1 |
| DI (mm) | 12 | 12.2 | 12.7 | 13.3 | 13.3 | 14.5 | 15 | 15.5 | 15.7 |
| D2 (mm) | 38.3 | 38.5 | 39 | 394 | 38.2 | 37.4 | 37.1 | 35.9 | 35.3 |
| D3 (mm) | 64.8 | 64.4 | 63.9 | 64.6 | 65 | 65.8 | 67.6 | 69.3 | 72.2 |
| Ixx | 47 | 48 | 51 | 60 | 70 | 80 | 86 | 95 | 97 |
| Izz | 239 | 245 | 250 | 259 | 278 | 291 | 304 | 316 | 319 |

FIG. 10

IRON-TYPE GOLF CLUB HEAD

FIELD

This disclosure relates generally to golf clubs, and more particularly to a head of an iron-type golf club that promotes desirable golf shots for relatively-high handicap players.

BACKGROUND

For beginner golfers and golfers with a relatively-high handicap, hitting a golf shot, using an iron-type golf club, with accuracy and with a desired shot shape can be difficult. Such golfers tend to hit shots that are off-target and have a low and slicing shot shape. Desirably, however, golfers want to hit accurate shots having a high and straight, or drawing, shot shape. Current iron-type golf clubs, such as so-called game improvement irons, are not designed to adequately promote golf shots having a desirable accuracy and shot shape for golfers with relatively high handicaps.

SUMMARY

The subject matter of the present application has been developed in response to the present state of the art, and in particular, in response to the shortcomings of conventional golf clubs and associated golf club heads. Accordingly, the subject matter of the present application has been developed to provide examples of a golf club and golf club head that overcome at least some of the above-discussed shortcomings of conventional golf clubs and associated golf club heads.

Disclosed herein is an iron-type golf club head that comprises a body. The body comprises a heel portion, a sole portion defining a sole of the iron-type golf club head, a toe portion, a top-line portion, a front portion, which comprises a strike face, and a rear portion. A ratio of a maximum toe height of the iron-type golf club head to a blade length of the iron-type golf club head is greater than zero and at most 0.62. The maximum toe height is no more than 52 mm. A ratio of the maximum toe height to a maximum heel height of the iron-type golf club head is between, and inclusive of, 1.4 and 1.55. The maximum heel height is no less than 25 mm. A maximum thickness of the front portion, along the strike face, corresponds with a location toeward of a geometric center of the strike face. The thickness of the front portion, at the geometric center of the strike face, is less than the maximum thickness of the front portion. A coefficient of restitution (COR) of the iron-type golf club head is at least 0.818 and at most 0.830. A Zup value of a center-of-gravity of the iron-type golf club head is at most between, and inclusive of, 13 mm and 19 mm. An entirety of the sole is rounded along a plane parallel to the strike face, and a radius of curvature of the sole, along the plane parallel to the strike face, is no more than between, and inclusive of, 100 mm and 275 mm. The preceding subject matter of this paragraph characterizes example 1 of the present disclosure.

A ratio of the maximum toe height of the iron-type golf club head to a maximum width of the sole of the iron-type golf club head is greater than zero and at most 1.67. The preceding subject matter of this paragraph characterizes example 2 of the present disclosure, wherein example 2 also includes the subject matter according to example 1, above.

The maximum depth of the iron-type golf club head is between, and inclusive of, 29 mm and 32 mm. The preceding subject matter of this paragraph characterizes example 3 of the present disclosure, wherein example 3 also includes the subject matter according to example 2, above.

An angle defined between a line, passing through a ground plane intersection point and a location on the iron-type golf club head corresponding with the maximum toe height, and the ground plane is at most 38°. The ground plane intersection point is defined as a point at which a hosel axis of the iron-type golf club head intersects the ground plane when the iron-type golf club head is in a proper address position on the ground plane. The preceding subject matter of this paragraph characterizes example 4 of the present disclosure, wherein example 4 also includes the subject matter according to any of examples 1-3, above.

A value of the maximum toe height of the iron-type golf club head divided by the COR of the iron-type golf club head is more than zero mm and no more than 62 mm. The preceding subject matter of this paragraph characterizes example 5 of the present disclosure, wherein example 5 also includes the subject matter according to any of examples 1-4, above.

A value of the COR of the iron-type golf club head divided by the Zup value of the center-of-gravity of the iron-type golf club head is at most 0.060 per mm and at least 0.040 per mm. The preceding subject matter of this paragraph characterizes example 6 of the present disclosure, wherein example 6 also includes the subject matter according to any of examples 1-5, above.

The Zup value of the center-of-gravity of the iron-type golf club head is between, and inclusive of, 16 mm and 19 mm. The preceding subject matter of this paragraph characterizes example 7 of the present disclosure, wherein example 7 also includes the subject matter according to any of examples 1-6, above.

The blade length is between, and inclusive of, 80 mm and 84 mm. The preceding subject matter of this paragraph characterizes example 8 of the present disclosure, wherein example 8 also includes the subject matter according to any of examples 1-7, above.

The maximum toe height is between, and inclusive of, 35 mm and 40 mm. The preceding subject matter of this paragraph characterizes example 9 of the present disclosure, wherein example 9 also includes the subject matter according to any of examples 1-8, above.

The thickness of the front portion is variable along the strike face. The thickness of the front portion, along the strike face, increases from the geometric center of the strike face to the location toeward of the geometric center of the strike face. The preceding subject matter of this paragraph characterizes example 10 of the present disclosure, wherein example 10 also includes the subject matter according to any of examples 1-9, above.

The maximum thickness of the front portion, along the strike face, is between, and inclusive of, 3.05 mm and 3.75 mm. The preceding subject matter of this paragraph characterizes example 11 of the present disclosure, wherein example 11 also includes the subject matter according to example 10, above.

A minimum thickness of the front portion, along the strike face, is between, and inclusive of, 1.35 mm and 1.85 mm. The preceding subject matter of this paragraph characterizes example 12 of the present disclosure, wherein example 12 also includes the subject matter according to example 11, above.

The thickness of the front portion, at the geometric center of the strike face, is between, and inclusive of, 2.65 mm and 3.45 mm. The preceding subject matter of this paragraph characterizes example 13 of the present disclosure, wherein example 13 also includes the subject matter according to any of examples 11-12, above.

The location corresponding with the maximum thickness of the front portion is at least 50 mm toeward of a ground plane intersection point of the iron-type golf club head. The preceding subject matter of this paragraph characterizes example 14 of the present disclosure, wherein example 14 also includes the subject matter according to any of examples 10-13, above.

A ratio of the maximum thickness of the front portion, along the strike face, to the thickness of the front portion, at the geometric center of the strike face, is between, and inclusive of, 1.1 mm and 1.75 mm. The preceding subject matter of this paragraph characterizes example 15 of the present disclosure, wherein example 15 also includes the subject matter according to any of examples 10-14, above.

When the iron-type golf club head is in an address position on a ground plane, a minimum height of the sole portion away from the ground plane, at a distance of about 15 mm heelward away from a point-of-contact of the sole with the ground plane, is between, and inclusive of, 0.9 mm and 1.4 mm. The preceding subject matter of this paragraph characterizes example 16 of the present disclosure, wherein example 16 also includes the subject matter according to any of examples 1-15, above.

When the iron-type golf club head is in an address position on a ground plane, a minimum height of the sole portion away from the ground plane, at a distance of about 22.5 mm heelward away from a point-of-contact of the sole with the ground plane, is between, and inclusive of, 12% and 22% of the Zup value of the iron-type golf club head. The preceding subject matter of this paragraph characterizes example 17 of the present disclosure, wherein example 17 also includes the subject matter according to any of examples 1-16, above.

When the iron-type golf club head is in an address position on a ground plane, a minimum height of the sole portion away from the ground plane, at a distance of about 7.5 mm toeward of a ground plane intersection point of the iron-type golf club head, is between, and inclusive of, 12% and 22% of the Zup value of the iron-type golf club head. The preceding subject matter of this paragraph characterizes example 18 of the present disclosure, wherein example 18 also includes the subject matter according to any of examples 1-17, above.

The iron-type golf club head further comprises an internal cavity defined between the heel portion, the sole portion, the toe portion, the top-line portion, the front portion, and the rear portion and an internal damper within the internal cavity, in contact with an internal surface of the front portion, opposite the strike face, and in contact with an internal surface of the rear portion. The internal damper has a hardness less than a hardness of the front portion of the body. The preceding subject matter of this paragraph characterizes example 19 of the present disclosure, wherein example 19 also includes the subject matter according to any of examples 1-18, above.

The internal damper comprises a pocket. The iron-type golf club head further comprises an internal stiffener within the pocket. A hardness of the internal stiffener is less than the hardness of the internal damper and less than the hardness of the front portion of the body. The preceding subject matter of this paragraph characterizes example 20 of the present disclosure, wherein example 20 also includes the subject matter according to example 19, above.

The body of the iron-type golf club head is made of a metallic material. Each one of the internal damper and the internal stiffener is made of a polymeric material. The preceding subject matter of this paragraph characterizes example 21 of the present disclosure, wherein example 21 also includes the subject matter according to example 20, above.

An entirety of the pocket is toeward of a geometric center of the strike face. The preceding subject matter of this paragraph characterizes example 22 of the present disclosure, wherein example 22 also includes the subject matter according to any of examples 20-21, above.

The pocket faces the top-line portion of the body and is open to the internal cavity. The preceding subject matter of this paragraph characterizes example 23 of the present disclosure, wherein example 23 also includes the subject matter according to example 21, above.

The pocket is interposed between and spaced apart from the internal surface of the front portion and the internal surface of the rear portion so that no part of the internal stiffener is in contact with the internal surface of the front portion and the internal surface of the rear portion. The preceding subject matter of this paragraph characterizes example 24 of the present disclosure, wherein example 24 also includes the subject matter according to any of examples 20-23, above.

A front-to-rear dimension of the internal damper, the pocket, and the internal stiffener increases in a direction from the heel portion to the toe portion. The preceding subject matter of this paragraph characterizes example 25 of the present disclosure, wherein example 25 also includes the subject matter according to any of examples 20-24, above.

The internal cavity comprises an unfilled portion. The preceding subject matter of this paragraph characterizes example 26 of the present disclosure, wherein example 26 also includes the subject matter according to any of examples 20-25, above.

The iron-type golf club head further comprises an internal cavity defined between the heel portion, the sole portion, the toe portion, the top-line portion, the front portion, and the rear portion. The rear portion comprises an opening and a badge covering the opening. The preceding subject matter of this paragraph characterizes example 27 of the present disclosure, wherein example 27 also includes the subject matter according to any of examples 1-26, above.

The sole portion comprises a sole slot extending lengthwise in a heel-to-toe direction. The iron-type golf club head further comprises a filler material within the sole slot. The preceding subject matter of this paragraph characterizes example 28 of the present disclosure, wherein example 28 also includes the subject matter according to any of examples 1-27, above.

The sole slot extends from a sole of the iron-type golf club head toward the top-line portion at an angle relative to the strike face of the front portion. The preceding subject matter of this paragraph characterizes example 29 of the present disclosure, wherein example 29 also includes the subject matter according to example 28, above.

The iron-type golf club head has a loft between 20 degrees and 34 degrees when the iron-type golf club head is in an address position on a ground plane. The preceding subject matter of this paragraph characterizes example 30 of the present disclosure, wherein example 30 also includes the subject matter according to any of examples 1-29, above.

The strike face is flat in a heel-to-toe direction. The preceding subject matter of this paragraph characterizes example 31 of the present disclosure, wherein example 31 also includes the subject matter according to any of examples 1-30, above.

A ratio of a width of the sole at the toe portion to a width of the sole at the heel portion is between, and inclusive of, 1.3 and 1.5. The preceding subject matter of this paragraph characterizes example 32 of the present disclosure, wherein example 32 also includes the subject matter according to any of examples 1-31, above.

A difference between a maximum characteristic time of the golf club head and a characteristic time at a location on the strike face, which is within a plane passing through the geometric center of the strike face and perpendicular to grooves formed in the strike face, and between first and second ones of the grooves closest to the sole, is between, and inclusive of, 30 microseconds and 90 microseconds. The preceding subject matter of this paragraph characterizes example 33 of the present disclosure, wherein example 33 also includes the subject matter according to any of examples 1-32, above.

Also disclosed herein is an iron-type golf club head that comprises a body, comprising a heel portion, a sole portion, a toe portion, a top-line portion, a front portion, which comprises a strike face, and a rear portion. A coefficient of restitution (COR) difference value, equal to a difference between a measured COR of the golf club head and a COR-testing calibration plate, is not lesser than −0.013. A ratio of a maximum toe height of the iron-type golf club head to a blade length of the iron-type golf club head is greater than zero and at most 0.62. A ratio of the maximum toe height of the iron-type golf club head to a maximum depth of the iron-type golf club head is greater than zero and at most 1.67. A value of the maximum toe height of the iron-type golf club head divided by the COR of the iron-type golf club head is more than zero and no more than 62 mm. A value of the COR of the iron-type golf club head divided by the Zup value of the center-of-gravity of the iron-type golf club head is at most 0.060 per mm and least 0.040 per mm. A maximum thickness of the front portion, along the strike face, corresponds with a location toeward of a geometric center of the strike face. A ratio of the maximum toe height to a radius of curvature of the sole portion, along a plane parallel to the strike face, is between, and inclusive of, 0.24 and 0.34. The preceding subject matter of this paragraph characterizes example 34 of the present disclosure.

Additionally disclosed herein is an iron-type golf club head that comprises a body, comprising a heel portion, a sole portion defining a sole of the iron-type golf club head, a toe portion, a top-line portion, a front portion, which comprises a strike face, and a rear portion. An angle defined between a line, passing through a ground plane intersection point and a location on the iron-type golf club head corresponding with a maximum toe height of the iron-type golf club head, and the ground plane is at most 38°. The ground plane intersection point is defined as a point at which a hosel axis of the iron-type golf club head intersects the ground plane when the iron-type golf club head is in a proper address position on the ground plane. An entirety of the sole is rounded along a plane parallel to the strike face, and a radius of curvature of the sole, along the plane parallel to the strike face, is no more than between, and inclusive of, 100 mm and 275 mm. The preceding subject matter of this paragraph characterizes example 35 of the present disclosure.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only some embodiments of the subject matter and are not therefore to be considered to be limiting of its scope, the subject matter will be described and explained with additional specificity and detail through the use of the drawings, in which:

FIG. 10 is a chart showing various characteristics and associated values for several examples of an iron-type golf club head, according to one or more examples of the present disclosure.

DETAILED DESCRIPTION

The following describes examples of golf club heads in the context of an iron-type golf club, but the principles, methods and designs described may be applicable in whole or in part to utility golf clubs (also known as hybrid golf clubs), metal-wood-type golf club, driver-type golf clubs, putter-type golf clubs, and the like.

U.S. Patent Application Publication No. 2014/0302946 A1 ('946 App), published Oct. 9, 2014, which is incorporated herein by reference in its entirety, describes a "reference position" (e.g., an address position) used to measure the various parameters discussed throughout this application. The reference or address position can be based on the procedures described in the United States Golf Association and R&A Rules Limited, "Procedure for Measuring the Club Head Size of Wood Clubs," Revision 1.0.0, (Nov. 21, 2003). Unless otherwise indicated, all parameters are specified with the club head in the address position, which is the position of the golf club head when (1) supported on a ground plane; (2) a hosel axis of the club head is at a lie angle θ1 of 60° relative to the ground plane or scorelines on the strike face of the golf club head are parallel relative to the ground plane; and (3) the hosel axis lies within a plane (e.g., vertical plane) that is perpendicular to the ground plane. In certain examples, the address position is associated with a lie angle θ1 that is close to 60°, such as the lie angles indicated in chart 200 of FIG. 10.

Figure 2:
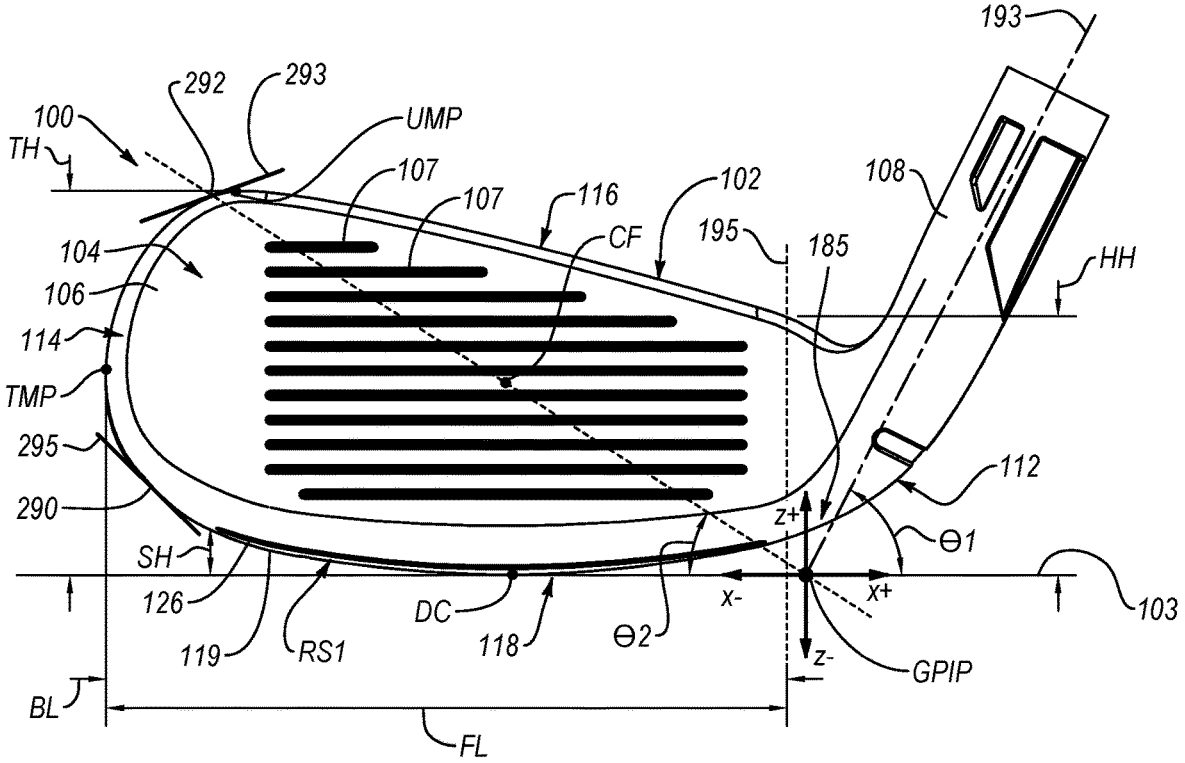
FIG. 2 is a schematic, front view of the golf club head of FIG. 1, according to one or more examples of the present disclosure.
Figure 3:
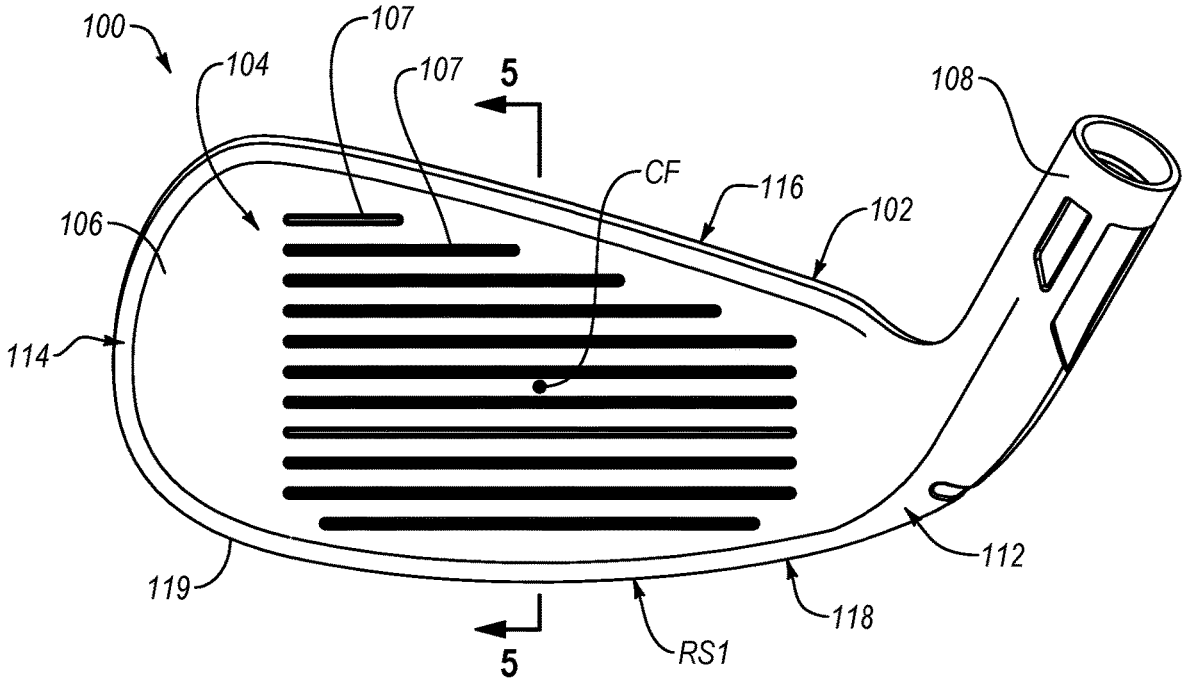
FIG. 3 is a schematic, perspective view of the golf club head of FIG. 1, from a location square to the strike face of the golf club head, according to one or more examples of the present disclosure.
Figure 4:
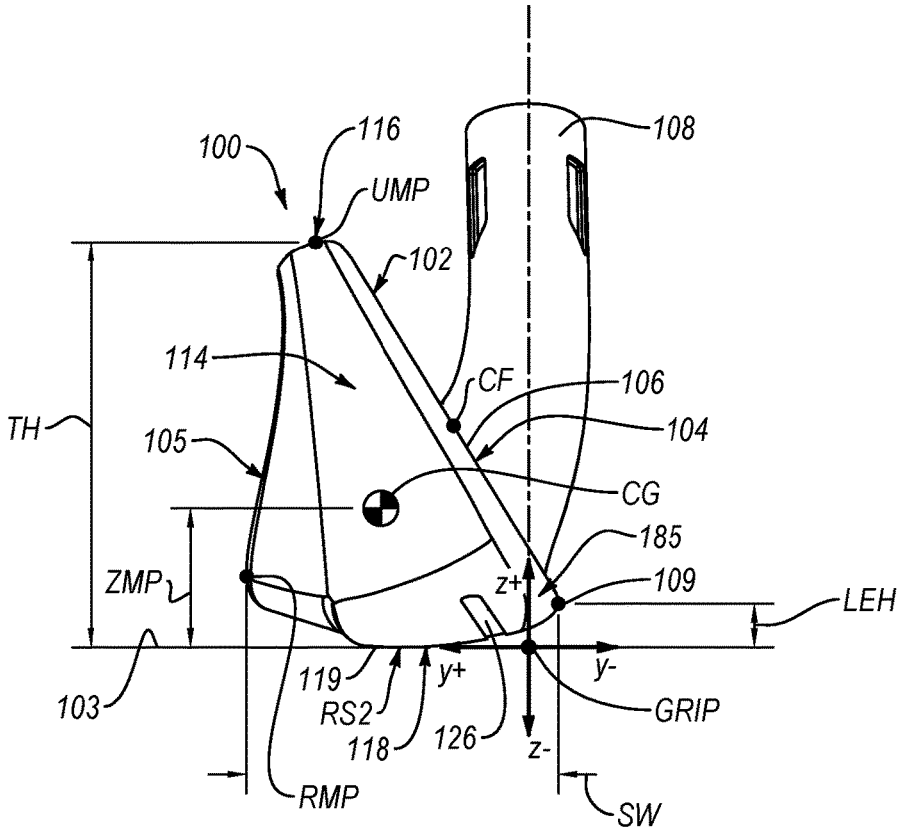
FIG. 4 is a schematic, side elevation view of the golf club head of FIG. 1, according to one or more examples of the present disclosure.

FIGS. 2 and 4 are examples that show a golf club head in the address position. As shown in FIGS. 2 and 4, positioning a golf club head in the address position lends itself to creating one or more coordinate systems, originating at any of various specified locations, for making various measurements. The axis of the coordinate systems can be tied to the ground plane, a first vertical plane perpendicular to the ground plane, and a second vertical plane perpendicular to both the ground plane and the first vertical plane. Generally, in most examples, the first vertical plane is parallel to the hosel axis (or the hosel axis lies in the first vertical plane). An x-axis of the coordinate system passes through a designated origin and either lies along the first vertical plane or is parallel to the first vertical plane. A y-axis of the coordinate system passes through the designated origin and either lies along the ground plane or is parallel to the ground plane. The z-axis of the coordinate system passes through the designated origin and either lies along the second vertical plane or is parallel to the second vertical plane. Additionally, the USGA methodology may be used to measure the various parameters described throughout this application including head height and club head center of gravity CG location. According to one example, a club head origin coordinate system 185 is defined with an origin at the ground plane intersection point (GPIP) as shown in FIGS. 2, 4, and, and described in more detail below. The positive x-axis is heelward of the GPIP and the negative x-axis is toeward of the GPIP. The positive y-axis is rearward of the GPIP and the negative y-axis is forward of the GPIP. The positive z-axis is upward of the GPIP and the negative z-axis is downward of the GPIP.

For further details or clarity, the reader is advised to refer to the measurement methods described in the '946 App and the USGA procedure. Notably, however, the origin and axes used in this application may not necessarily be aligned or oriented in the same manner as those described in the '946 App or the USGA procedure. Further details are provided below on locating the club head origin coordinate system 185.

Figure 1:
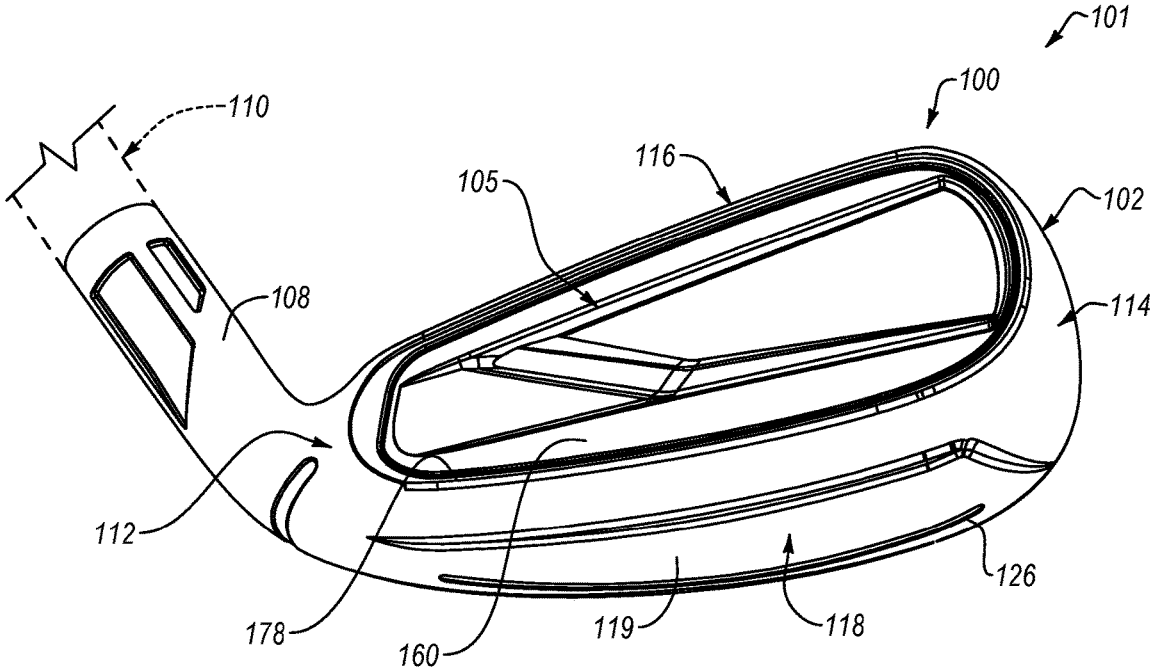
FIG. 1 is a schematic, perspective view of an iron-type golf club head, from a rear of the golf club head, according to one or more examples of the present disclosure.

Referring to FIGS. 1 and 2, and according to one example, a golf club head 100 includes a body 102 and a hosel 108 coupled to and extending from the body 102. Some features of the golf club head 100 are similar to the features of the iron-type golf club head shown and described in U.S. patent application Ser. No. 15/706,632, filed Sep. 15, 2017, which is incorporated herein in its entirety. The body 102 has a toe portion 114, a heel portion 112, a top-line portion 116 (e.g., top portion), a sole portion 118 (e.g., bottom portion), a front portion 104, and a rear portion 105. The toe portion 114 defines a side of the body 102 that is opposite a side of the body 102 defined by the heel portion 112 in a direction parallel to an x-axis of the club head origin coordinate system 185. The top-line portion 116 defines a side of the body 102 that is opposite a side of the body 102 defined by the sole portion 118 in a direction parallel to a z-axis of the club head origin coordinate system 185. The front portion 104 defines a side of the body 102 that is opposite a side of the body 102 defined by the rear portion 105 in a direction parallel to a y-axis of the club head origin coordinate system 185.

As shown in FIG. 2, a lower tangent point 290 on the outer surface of the golf club head 100, when in the address position, of a line 295 forming a 45° angle relative to the ground plane 111, defines a demarcation boundary between the sole portion 118 and the toe portion 114. Similarly, an upper tangent point 292 on the outer surface of the golf club head 100, when in the address position, of a line 293 forming a 45° angle relative to the ground plane 111 defines a demarcation boundary between the top-line portion 116 and the toe portion 114. In other words, the portion of the golf club head 100 that is above and to the left (as viewed in FIG. 2) of the lower tangent point 290 and below and to the left (as viewed in FIG. 2) of the upper tangent point 292 is the toe portion 114.

The front portion 104 of the body 102 includes a strike face 106 designed to impact a golf ball during a normal golf swing. The strike face 106 has a planar surface that is angled relative to a ground plane 103 when the golf club head 100 is in the address position to define a loft of the golf club head 100. In other words, the strike face 106 of the golf club head 100 does not include a curved surface. Accordingly, the strike face 106 of the golf club head 100 is defined as the portion of the front portion 104 with an outwardly facing planar surface. Although the front portion 104 may include a curved surface, such as an outer surface of a sole wrap portion, the strike face 106 does not include or is not defined by such a curved surface. In contrast, the strike face of a metal-wood, driver, or hybrid golf club head does have a curved surface that curves around a substantially upright axis. The strike face 106 has a face length FL that is equal to the distance between a par line 195 of the golf club head 100 and a toewardmost point of the golf club head 100 as shown in FIG. 2. The par line 195 is defined as a theoretical line defining the transition on the front portion 104 between a flat surface to a curved surface generally proximate to the heel end of the golf club head 100. Put another way, the par line 195 defines where the flat surface of the front portion 104 ends and the curved surface of the front portion 104 begins.

The front portion 104 further includes grooves 107 (e.g., scorelines), formed in the strike face 106, which help promote desirable flight characteristics (e.g., backspin) of a golf ball upon impacted by the strike face 106. The grooves 107 are vertically spaced apart from, and parallel to, each other and can extend across all or just a portion of the width of strike face 106 at their respective vertical locations on the strike face 106.

Figure 5:
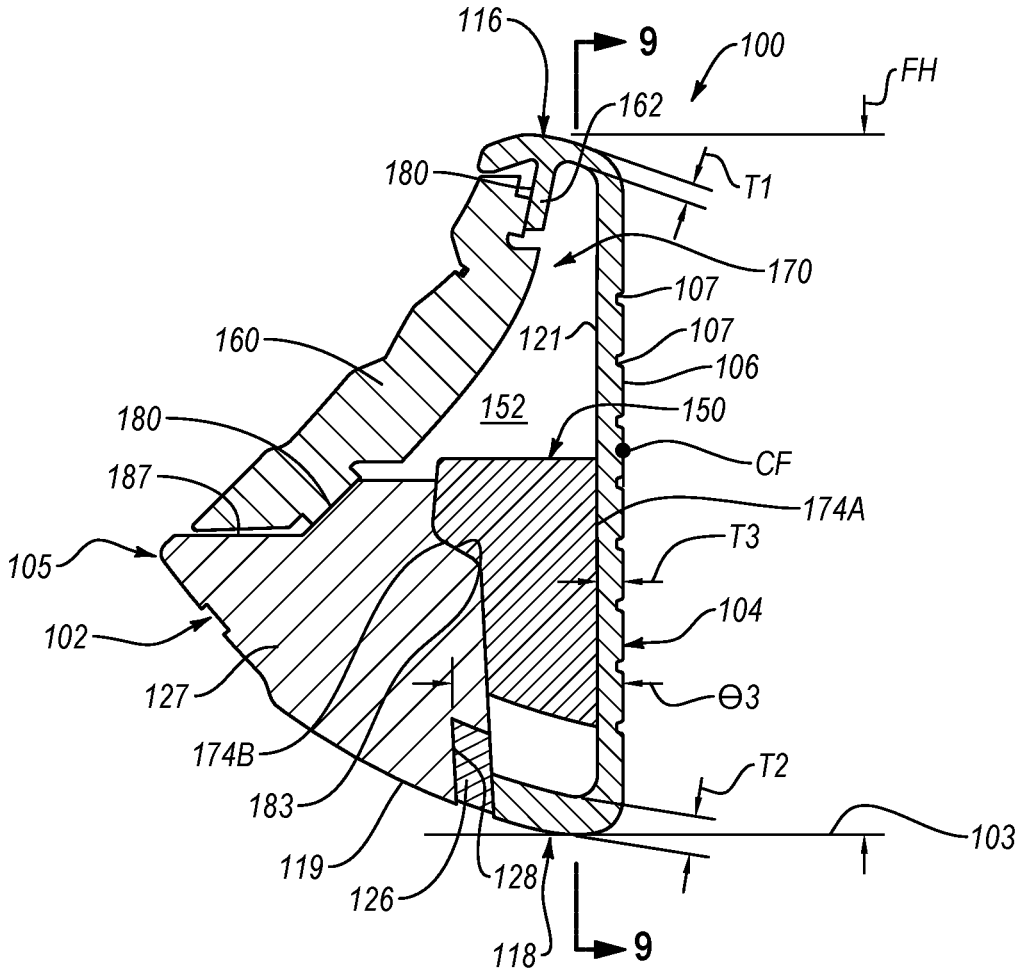
FIG. 5 is a schematic, sectional, side elevation view of the golf club head of FIG. 1, taken along the line 5-5 of FIG. 3, according to one or more examples of the present disclosure.

The front portion 104 also includes an interior surface 121, which is opposite the strike face 106 and separated from the strike face 106 by a thickness T3 of the front portion 104 (see, e.g., FIG. 5). In some examples, the thickness T3 is variable across the strike face 106, as described below. In some examples, the portion of the front portion 104 that defines the strike face 106 is co-formed with the top-line portion 116, the sole portion 118, the heel portion 112, the toe portion 114, and at least a portion of the rear portion 105, such that these portions of the body 102 and the strike face 106 form a one-piece, monolithic, seamless, and unitary, construction. Accordingly, in these examples, the strike face 106 is not defined by a separate strike plate attached to the rest of the body 102, but instead the body 102 and the strike face 106 are formed from the same manufacturing process, such as being co-cast or co-machined together in certain examples. However, in other examples, the strike face 106 is defined by a strike plate that is formed separately from and attached to (e.g., welded to, adhered to, etc.) the rest of the front portion 104 of the body 102. For example, the front portion 104 can include a front opening and a strike plate can be attached to the front portion 104 over the front opening. In some implementations, a strike plate can include an entirety of the strike face 106, or just a portion of the strike face 106. The strike face 106 includes a leading edge 109, which is defined as the forwardmost portion or edge of the strike face 106 (see, e.g., FIG. 4).

The hosel 108 extends from the heel portion 112 of the body 102. The hosel 108 is configured to receive and engage with a shaft and grip combination 110 of a golf club 101. The shaft extends from the hosel 108 and the grip is secured to the shaft at a location on the shaft opposite that of the golf club head 100. Referring to FIG. 2, the hosel 108 defines a hosel axis 193, which is a central axis of the hosel 108. The hosel axis 193 helps define a ground plane intersection point GPIP, which is the point at which the hosel axis 193 intersects the ground plane 103 when the golf club head 100 is in an address position on the ground plane 103.

The body 102 can have a multiple-piece construction with each piece being made from the same or a different material, and/or formed by the same or a different process. Separately forming and attaching together different parts of the body 102 and/or making different parts of the body 102 from different materials, enables allows flexibility in the types of manufacturing processes and materials used, promotes the ability to make a golf club head that achieves a wide range of performance, aesthetic, and economic results.

Referring FIG. 5, the rear portion 105 is coupled to and extends rearwardly from the sole portion 118. The rear portion 105 is also coupled to and extends rearwardly from lower parts of the heel portion 112 and the toe portion 114. The body 102 includes a sole bar 127 formed in part of the rear portion 105 and part of the sole portion 118. The sole bar 127 is located in a low, rearward portion of the golf club head 100. The sole bar 127 has a relatively large thickness in relation to the strike face 106 of the front portion 104, and other portions of the golf club head 100, thereby accounting for a significant portion of the mass of the golf club head 100, and thereby shifting the CG of the golf club head 100 relatively lower and rearward. The sole bar 127 defines an internal shelf 183 and an external shelf 187 of the sole portion 118.

Referring to FIGS. 1, 2, 4, and 5, the body 102 of the golf club head 100 further includes a sole slot 128 formed in the sole portion 118 of the body 102. Generally, the sole slot 128 is a groove or channel formed in a sole 119 of the golf club head 100. The sole 119 is defined as the exterior surface of the sole portion 118. The sole slot 128 is elongated in a lengthwise direction substantially parallel to the strike face 106. In the illustrated examples, the sole slot 128 is a through-slot, or a slot that is open on a sole portion side of the sole slot 128 and open on an internal cavity side or interior side of the sole slot 128. However, in other implementations, the sole slot 128 is not a through-slot, but rather is closed on an internal cavity side or interior side of the sole slot 128. Referring to FIG. 5, the sole slot 128 extends from the sole upwards towards the interior cavity 152. Along a plane that is perpendicular to the strike face 106, the sole slot 128 extends from the sole at an angle θ3 relative to the strike face 106. According to some examples, the angle θ3 is between, and inclusive of 1° and 5°. In certain examples, the angle θ3 is equal to 3°.

In some examples, the sole slot 128 is filled with a filler material 126. The filler material 126 is made from a non-metal, such as a thermoplastic material, thermoset material, and the like, in some implementations. In other implementations, the sole slot 128 is not filled with the filler material 126, but rather maintains an open, vacant, space within the sole slot 128.

In some embodiments, the filler material 126 may be press-fit or adhesively bonded into a slot, channel, or other flexible boundary structure. In other embodiments, a filler material may poured, injected, or otherwise inserted into a slot or channel and allowed to cure in place, forming a sufficiently hardened or resilient outer surface. In still other embodiments, a filler material may be placed into a slot or channel and sealed in place with a resilient cap or other structure formed of a metal, metal alloy, metallic, composite, hard plastic, resilient elastomeric, or other suitable material.

Figure 7:
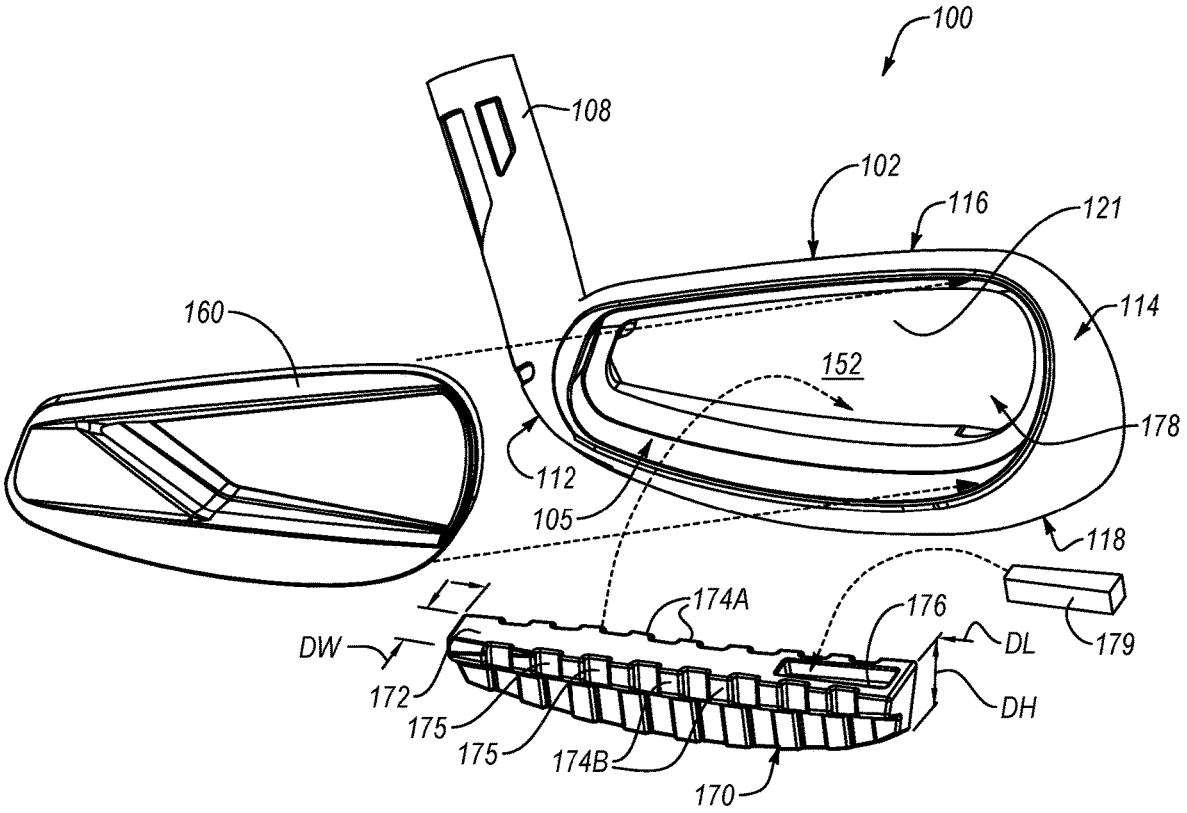
FIG. 7 is a schematic, exploded, perspective view of the golf club head of FIG. 1, according to one or more examples of the present disclosure.

Referring to FIGS. 1, 5, and 7, the rear portion 105 of the body 102 includes an opening 178 and a badge 160 (e.g., a rear panel or rear fascia) coupled to and enclosing the opening 178. The opening 178 is open to an internal cavity 152 of the golf club head 100. In other words, the internal cavity 152 is accessible through the opening 178 when uncovered. The rear portion 105 includes a lip 180 that continuously surrounds and defines the perimeter of the opening 178. The lip 180 is recessed relative to adjacent surfaces of the rear portion 105 and configured to receive the badge 160 in seated engagement. The badge 160 is affixed to the lip 180 via any of various techniques, such as welding, brazing, gluing, adhering, fastening, and the like. The size and shape of the outer periphery of the badge 160 complements the size and shape of the lip 180, such that when in seated engagement with the lip 180, the badge 160 covers the entirety of the opening 178. In this manner, the badge 160 encloses the opening 178, as well as the internal cavity 152, which is defined as the cavity defined between internal surfaces of the heel portion 112, the toe portion 114, the top-line portion 116, the sole portion 118, the front portion 104 and the rear portion 105, including the badge 160. Accordingly, when the badge 160 is in seated engagement with the lip 180, the body 102 of the golf club head 100 is hollow (i.e., the internal cavity 152 is enclosed). For this reason, the iron-type golf club head 100 is considered to have a hollow-body design.

Figure 8:
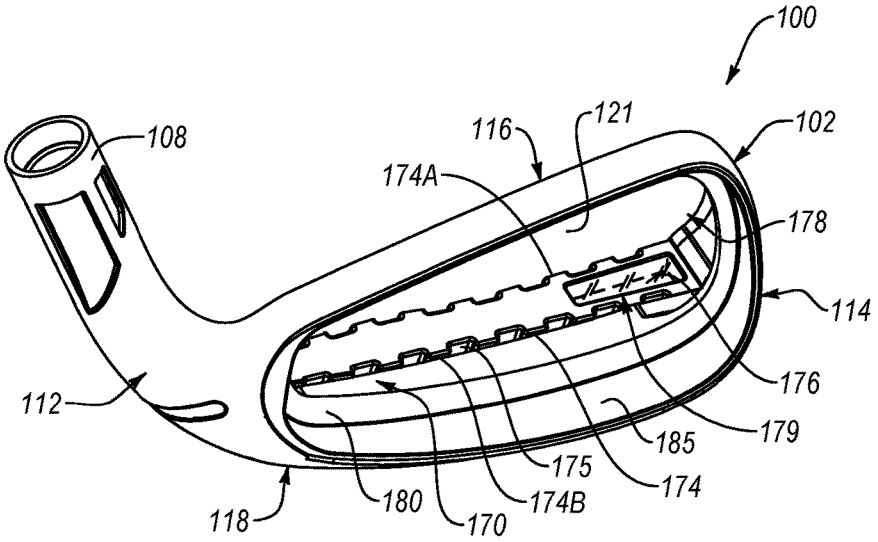
FIG. 8 is a schematic, perspective view of the golf club head of FIG. 1, shown with a badge removed, according to one or more examples of the present disclosure.

Referring to FIGS. 5, 7, and 8, the golf club head 100 further includes an internal damper 170 within the internal cavity 152 of the golf club head 100. The internal damper 170 provides acoustic dampening of the golf club head 100. For example, the internal damper 170 helps to counteract unpleasant sounds and vibration frequencies produced by various features of the golf club head when the golf club head 100 impacts a golf ball. Moreover, the internal damper 170 is configured so that a coefficient of restitution COR of the golf club head 100 remains above a desired COR while providing acoustic dampening of the golf club head 100. The internal damper 170 is positioned within the internal cavity 152 so that a portion of the internal damper 170 is in contact with the interior surface 121 of the front portion 104, at the strike face 106, and a portion of the internal damper 170 is in contact with the internal shelf 183 of the sole portion 118. In some examples, the sole portion 118 includes a sole bar 127 and the internal shelf 183 is an interior surface of the sole bar 127. The internal damper 170 is made of a material that is less stiff (e.g., softer) than the material of the front portion 104 and the material of the sole bar 127.

In certain examples, the internal damper 170 includes front ribs 174A (e.g., front projections) on a front facing surface of the internal damper 170 and rear ribs 174B (e.g., rear projections) on a rear facing surface of the internal damper 170. The front ribs 174A are spaced apart in a heel-to-toe direction and the rear ribs 174B are spaced apart in the heel-to-toe direction. Gaps 175 (e.g., cutouts) are defined between adjacent ones of the front ribs 174A and adjacent ones of the rear ribs 174B. Only the front ribs 174A contact the interior surface 121 of the front portion 104 and only the rear ribs 174B contact the internal shelf 183 of the sole portion 118. In this manner, acoustic dampening can be achieved without negatively affecting the COR properties of the golf club head 100. In some examples, the front ribs 174A are attached to the interior surface 121 of the front portion 104, and the rear ribs 174B are attached to the internal shelf 183 of the sole portion 118 via an adhesive or glue.

Referring to FIG. 7, the internal damper 170 has a height DH (e.g., a top-to-bottom dimension), generally parallel to the strike face 106 and top-to-sole direction, and a width DW (e.g., a front-to-rear dimension), generally perpendicular to the strike face 106. A length DL of the internal damper 170 is generally parallel to the strike face 106 and a heel-to-toe direction. In some examples, one or both of the height DH and the width DW of the internal damper 170 varies along a length DL of the internal damper 170. For example, as shown, in a heel-to-toe direction, the width DW of the internal damper 170 increases such that the internal damper 170 widens in the heel-to-toe direction. Such a configuration provides increased acoustic dampening toeward of a geometric center CF of the strike face 106, wherein effects of acoustic vibrations may be more pronounced, relative to heelward of the geometric center CF. As defined herein, the geometric center CF can be an ideal impact location on the strike face 106. Additionally, or alternatively, the geometric center CF can be defined by the USGA center face template method, as is known in the art. According to some examples, the geometric center CF is an ideal impact location on the strike face 106, which is defined as a point on the strike face 106 that lies in a horizontal plane (parallel to the ground plane 103) that passes through the CG, and lies in a vertical plane (perpendicular to the ground plane 103) that passes through the CG and is perpendicular to the strike face 106, when the golf club head is in the address position on the ground plane 103. Additionally, or alternatively, as shown, in the heel-to-toe direction, the height DH of the internal damper 170 increases for at least a portion of the length DL of the internal damper 170. Also, in some examples, in the heel-to-toe direction, the height DH of the internal damper 170 decreases for at least a portion of the length DL, so that the internal damper 170 gets taller for a first portion of the internal damper 170 and shorter for a second portion of the internal damper 170. In some examples, in the heel-to-toe direction, the height DH increases up to a middle portion of the internal damper 170 and decreases away from the middle portion of the internal damper 170, so that the internal damper 170 is taller, and contacts more surface area at a middle portion of the front portion 104, than at toe and heel portions of the front portion 104.

As shown in FIGS. 7 and 8, the golf club head 100 also includes an internal stiffener 179 coupled to the internal damper 170. The internal stiffener 179 is made of a material that is stiffer (e.g., harder) than the internal damper 170, but less stiff than the material of the front portion 104 and the material of the sole bar 127. In some examples, the internal damper 170 is made of a first type of polymeric material, the internal stiffener 179 is made of a second type of polymeric material, different than the first type of polymeric material, and the front portion 104 and the sole bar 127 are made of a metallic material. The internal damper 170 includes a pocket 176 (e.g., recess) and the internal stiffener 179 is located (e.g., seated) within the pocket 176. The internal stiffener 179 can be fixed within the pocket 176 via an adhesive or glue, or frictionally engaged via interlocking features. The pocket 176 is formed in a top surface 172 of the internal damper 170. The top surface 172 faces the top-line portion 116 of the body 102 or faces upwardly away from the ground plane 103 when the golf club head 100 is in the address position on the ground plane 103. Accordingly, the pocket 176 also faces the top-line portion 116 of the body 102. The pocket 176 has an opening so that the pocket 176 is open to the interior cavity 152, which enables the internal stiffener 179 to be introduced into the pocket 176 through the opening 178 in the rear portion 105 and through the internal cavity 152.

In some examples, the pocket 176 is positioned on the top surface 172 of the internal damper 170 so that the pocket 176 is interposed between and spaced apart from the interior surface 121 of the front portion 104 and any internal surface of the rear portion 105 so that no part of the internal stiffener 179 is in contact with the interior surface 121 of the front portion and any internal surface of the rear portion 105. According to some examples, a ratio of the volume of the internal damper 170 to the volume of the internal stiffener 179 is between and inclusive of, 0.02 and 0.18. In certain examples, a ratio of the mass of the internal damper 170 to the mass of the internal stiffener 179 is between and inclusive of, 0.10 and 0.25 (or preferably between, and inclusive of, 0.15 and 0.19). The pocket 176 has a volume between, and inclusive of, 250 $mm^2$ and 1,250 $mm^2$, in some examples, and between, and inclusive of, 450 $mm^2$ and 850 $mm^2$, in other examples.

In some examples, the golf club head 100 does not include an internal stiffener 179 in the pocket 176. Instead, the pocket 176 is at least partially filled with a sticky material configured to remain sticky at room temperature, and adhere to loose material within the interior cavity 152. After production and during use of a golf club head, particularly those with an enclosed interior cavity, materials, such as metal shavings, pieces of epoxy, and/or pieces of weldments, can become loose and move around the interior cavity during use. Movement of such materials within the interior cavity can negatively affect the performance and acoustics of the golf club head. By placing the sticky material within the pocket 176, the loose materials become adhered to the sticky material, which captures and retains the loose materials and prevents the materials from moving around inside the interior cavity 152. In certain examples, the sticky material is a glue or an adhesive, such as hot melt. Positioning the sticky material within the pocket 176 helps ensure the sticky material does not contact the interior of the front portion 104, opposite the strike face 106.

In some examples, at least a portion of the pocket 176 is toeward of the geometric center CF of the strike face 106. Moreover, in certain examples, as shown, an entirety of the pocket 176 is toeward of the geometric center CF of the strike face 106. When at least partially filled with the internal stiffener 179, positioning all or a portion of the pocket 176 toeward of the geometric center CF helps to locally stiffen the strike face 106 and enables a thinner face in that region, which saves mass that can be redistributed lower and toward for increased inertia. Also, stiffening the tow region with the internal stiffener 179 promotes a draw or left hit bias. The internal stiffener 179 and internal damper 170 can cooperatively promote local stiffening of the strike face 106, which enables a more constant thickness strike face 106, thus achieving a higher durability and COR performance. Like the internal damper 170, in some examples, a width of the pocket 176 and the internal damper 170 increase, in a heel-to-toe direction, such that the pocket 176 and the internal damper 170 widen in the heel-to-toe direction.

The internal damper 170, in some examples, includes features and functionality similar to or analogous of the features and functionality of the damper disclosed in U.S. patent application Ser. No. 17/566,131, filed Dec. 20, 2021, which is incorporated herein by reference in its entirety.

According to some examples, other than the internal damper 170 and the internal stiffener 179, the internal cavity 152 is unfilled. In other words, in some examples, at least a portion of the internal cavity 152 is unfilled (e.g., void of material other than air). However, in other examples, the internal cavity 152 is filled with a filler material.

The features of the golf club head 100 are made from one or more materials. The combination of materials of the golf club head 100 promote aesthetic, acoustic, and/or performance qualities of the golf club head 100. A first material can be different than a second material when the first material has a different composition than the second material. Accordingly, materials from the same family, such as steel, but with different compositional characteristics, such as different carbon constituencies, are considered different materials.

All or just a portion of the body 102 of the golf club head 100 is made of a metallic material, such as a titanium alloy or a steel alloy. In some examples, at least the heel portion 112, the sole portion 118, the toe portion 114, the front portion 104, and some of the rear portion 105 are made of a steel alloy. The steel alloy can be one or more of maraging steel, maraging stainless steel, or precipitation-hardened (PH) stainless steel. In general, maraging steels have high strength, toughness, and malleability. Being low in carbon, they derive their strength from precipitation of inter-metallic substances other than carbon. The principal alloying element is nickel (15% to nearly 30%). Other alloying elements producing inter-metallic precipitates in these steels include cobalt, molybdenum, and titanium. In one example, the maraging steel contains 18% nickel. Maraging stainless steels have less nickel than maraging steels but include significant chromium to inhibit rust. The chromium augments hardenability despite the reduced nickel content, which ensures the steel can transform to martensite when appropriately heat-treated. In another example, the steel alloy is a maraging stainless steel C455. In yet other examples, the steel alloy is a precipitation hardened stainless steel such as 17-4, 15-5, or 17-7. The steel alloy is C300 steel, in some examples. In yet further examples, the steel alloy is one or more of a carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), or austenitic stainless steel (e.g., 304, N50, or N60 stainless steel (e.g., 410 stainless steel). In addition to those noted above, some examples of metals and metal alloys that can be used to form the components of all or just a portion of the body 102 of the golf club head 100, include without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

In some examples, the badge 160 is made of a material that is different than the rest of the body 102. Accordingly, the rear portion 105 can be made of different materials. In one example, the badge 160 is made of a steel alloy, an aluminum alloy, and/or a polymeric material. The badge 160 is made from one or more of the polymeric materials described herein, in some examples, and adhered or bonded to the body 102. In other examples, the badge 160 is made from one or more of the metallic materials described herein and adhered, bonded, or welded to the body 102. The badge 160 can have a density ranging from about 0.9 g/cc to about 5 g/cc. Moreover, the badge 160 may be a plastic, a carbon fiber composite material, a titanium alloy, or an aluminum alloy. In certain embodiments, where the badge 160 is made of aluminum, the badge 160 may be anodized to have various colors such as red, blue, yellow, or purple.

According to some examples, the filler material 126 is initially a viscous material that is injected or otherwise inserted into the sole slot 128. Examples of materials that may be suitable for use as the filler material 126, to be placed into the sole slot 128, channel, or other flexible boundary structure include, as well as the material of the internal damper 170, and/or a filler material within the internal cavity 152, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd.

In some examples, the internal damper 170 is made of a material that has a density of about 0.95 g/cc to about 1.75 g/cc, or about 1 g/cc. The material of the internal damper 170 can have a hardness of about 10 to about 70 shore A hardness. In certain examples, a shore A hardness of about 40 or less is preferred. In certain examples, a shore D hardness of up to about 40 or less is preferred.

In some examples, the material of the internal damper 170 has a density between about 0.16 g/cc and about 0.19 g/cc or between about 0.03 g/cc and about 0.19 g/cc. In certain examples, the density of the material of the internal damper 170 is in the range of about 0.03 g/cc to about 0.2 g/cc, or about 0.04-0.10 g/cc. The density of the material of the internal damper 170 may impact the COR, durability, strength, and damping characteristics of the golf club head 100. In general, a lower density material will have less of an impact on the COR of the golf club head 100. The damper material may have a hardness range of about 15-85 Shore 00 hardness or about 80 Shore 00 hardness or less. In one or more examples, the internal damper 170 has different durometers across the length DL of the internal damper 170. For example, the internal damper 170 may be co-molded using different materials with different durometers, masses, densities, colors, and/or other material properties. In one example, the internal damper 170 may be provided with a softer durometer adjacent to the ideal striking location of the strike face 106 than adjacent to heel and toe portions of the strike face 106. In another example, the internal damper 170 may be provided with a harder durometer adjacent to the ideal striking location of the strike face 106 than adjacent to the heel and toe portions of the strike face 106. In these examples, the different material properties used to co-mold the internal damper 170 may provide for better performance and appearance.

Additional and different materials of and manufacturing processes for the internal damper 170 can be used in one or more examples. For example, additional damper materials and manufacturing processes that can be used are described in U.S. Pat. Nos. 10,427,018, 9,937,395, 9,044,653, 8,920,261, and 8,088,025, which are incorporated by reference herein in their entireties. As another example, the internal damper 170 may be manufactured at least in part of rubber, silicone, elastomer, another relatively low modulus material, metal, another material, or any combination thereof.

In certain examples, the internal stiffener 179 is made of any of various polymeric materials having a hardness equal to or greater than about Shore 20D. In another example, the polymeric material of the internal stiffener 179 is any of various polymeric materials having a hardness equal to or greater than about Shore 45D. In yet another example, the polymeric material of the internal stiffener 179 is any of various polymeric materials having a hardness equal to or greater than about Shore 85D. The polymeric material is acrylic in one example. In some examples, the internal stiffener 179 has a hardness between Shore 40D and Shore 80D or between Shore 75D and Shore 85D. In yet some examples, the internal stiffener 179 has a hardness of at least Shore 50D, at least Shore 60D, or at least Shore 70D. In yet some examples, the internal stiffener 179 is any of various polymeric materials having a hardness equal to or greater than about Shore 5.95D.

In other implementations, some examples of the polymeric material of the internal stiffener 179 include, without limitation, viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchdamp™ from 3M, Sorbothane® from Sorbothane, Inc., DYAD® and GP® from Soundcoat Company Inc., Dynamat® from Dynamat Control of North America, Inc., NoViFlex™ Sylomer® from Pole Star Maritime Group, LLC, Isoplast® from The Dow Chemical Company, and Legetolex™ from Piqua Technologies, Inc. In one example the polymeric material of the internal stiffener 179 may be a material having a modulus of elasticity ranging from about 0.001 GPa to about 25 GPa, and a durometer ranging from about 10 to about 30 on a Shore D scale. In a preferred example, the polymeric material of the internal stiffener 179 may be a material having a modulus of elasticity ranging from about 0.001 GPa to about 10 GPa, and a durometer ranging from about 15 to about 25 on a Shore D scale. In another example, the polymeric material is a material having a modulus of elasticity ranging from about 0.001 GPa to about 5 GPa, and a durometer ranging from about 18 to about 22 on a Shore D scale. In some examples, a material providing vibration damping is preferred.

The polymeric material of the internal stiffener 179 is a thermoset material, such as epoxies, resins, and the like, in some examples. A thermoset material is any of various polymer materials that undergo a chemical transformation, which hardens and strengthens the material, when heated above a cure temperature of the material. The chemical transformation of thermoset materials is non-reversible. The polymeric material of the internal stiffener 179 is a thermoplastic material, such as polyester, polyethylene, and the like, in other implementations. In contrast to thermoset materials, a thermoplastic material is any of various polymer materials that undergo a physical transformation when heated, which softens the material, and cooled, which hardens the material. The physical transformation of thermoplastic materials is reversible.

The shape, thicknesses, weight distribution, and dampening/stiffening features of the golf club head 100 collectively contribute to promoting accurate and desirably shaped golf shots, particularly for beginner golfers and golfers with relatively-high handicaps. In some examples, the golf club head 100 is shaped to have a shallow strike face and a uniquely rounded sole. Unless otherwise defined, all dimensions are associated with the golf club head 100 when the golf club head 100 is in the address position on the ground plane 103. Referring to FIG. 2, the golf club head 100 has a blade length BL defined as the distance between the ground plane intersection point GPIP and the vertical projection onto the ground plane 191 from the toewardmost point of the golf club head 100, when the golf club head 100 is in the address position on the ground plane 191. Additionally, the golf club head 100 has a maximum toe height TH (e.g., head height) defined as the vertical distance from the ground plane 191 to an uppermost point UMP of the body 102 of the golf club head 100, which is located on the top-line portion 116 of the body 102 and identifies a maximum toe height of the toe portion 114. It is recognized that in some examples, the uppermost point UMP may be on the top-line portion 116 and not the toe portion 114, according to the definition of the top-line portion 116 and the toe portion 114 provided above. In such examples, the maximum toe height TH is then considered a maximum height of the top-line portion 116. In other words, as used herein, the maximum toe height TH is equal to the maximum height of the golf club head 100, excluding the hosel 108.

Referring to FIG. 5, the golf club head 100 also has a face height FH, which is defined as the vertical distance from a ground plane 103 to the uppermost point on the golf club head 100, when the golf club head 100 is resting on the ground plane 103, the grooves 107 are parallel to the ground plane 103, and the strike face 106 is perpendicular to the ground plane 103. A par face height, defined as the vertical distance from the ground plane 103 to a point where the par line 195 intersects with the top-line portion 116, when the golf club head 100 is resting on the ground plane 103, the grooves 107 are parallel to the ground plane 103, and the strike face 106 is perpendicular to the ground plane 103.

Due to the shallow nature of the golf club head 100, in some examples, a ratio of the maximum toe height TH to the blade length BL is at most 0.67 (e.g., between, and inclusive of, 0.39 and 0.67), at most 0.62 (e.g., between, and inclusive of, 0.45 and 0.62), or at most 0.59 (e.g., between, and inclusive of, 0.54 and 0.59). According to certain examples, the maximum toe height TH is between, and inclusive of, 35 mm and 50 mm, between, and inclusive of, 38 mm and 49 mm, or between, and inclusive of, 45 mm and 48 mm. In certain examples, the maximum toe height TH is no more than 52 mm. In these and other examples, the blade length BL of the golf club head 100 is between, and inclusive of, 75 mm and 90 mm, between, and inclusive of, 79 mm and 84 mm, or between, and inclusive of, 81 mm and 84 mm.

Referring to FIG. 2, the golf club head 100 has a maximum heel height HH that is defined as the vertical distance from the ground plane 191 to a point where the par line 195 intersects the top-line portion 116. In some examples, a ratio of the maximum toe height TH to the maximum heel height HH is between, and inclusive of, 1.4 and 1.55. In certain examples, the maximum heel height HH is no less than 25 mm.

The sole 119 is rounded along a plane parallel to the strike face 106, and along a plane perpendicular to the strike face 106. To promote contact with the golf ball more square and at a location higher on the strike face 106, the sole 119 of the golf club head 100 has a uniquely small radius of curvature along the plane parallel to the strike face or a vertical plane parallel to the x-axis of the club head origin coordinate system 185. Accordingly, the curvature of the sole 119 along the plane parallel to the strike face is the toe-to-heel curvature of the sole 119 when viewed from the front, such as shown in FIG. 2, and not the front-to-rear curvature of the sole 119 when viewed from the side, such as shown in FIG. 4. A radius of curvature RS1 of the sole 119 along the plane parallel to the strike face 106 is no more than 150 mm at any portion of the sole 119, according to some examples. Accordingly, the sole 119 is not relative flat along the plane, as is the case with traditional golf club heads, but rather has a substantial curvature extending along the sole 119 from the heel portion 112 to the toe portion 114. In some examples, the radius of curvature RS1 of the sole 119 is no more than 148 mm, no more than 146 mm, no more than 145 mm, or no more than 144 mm. In some examples, the radius of curvature RS1 of the sole 119 is no more than those listed in the above examples, and constant, at least 15 mm toeward and at least 15 mm heelward from a centerplane of the radius of curvature RS1 of the sole 119. A second radius of curvature RS2 of the sole 119 along a plane perpendicular to the strike face 106 can also be defined. In some examples, the second radius of curvature RS2 is about 125 mm.

The lower radius of curvature RS1 and the lower maximum toe height TH of the golf club head 100 promote performance of the golf club head 100. In some examples, a ratio of the maximum toe height TH to the radius of curvature RS1 of the sole 119 is between, and inclusive of, 0.24 and 0.34, between, and inclusive of, 0.26 and 0.32, or between, and inclusive of, 0.28 and 0.30.

Because of the radius of curvature RS1 of the sole 119, other than a point-of-contact PC with the ground plane 103, a significant gap is defined between the sole 119 and the ground plane 103 when the golf club head 100 is in the address position on the ground plane 103. The minimum gap defined between the sole 119 and the ground plane 103 is termed the sole height SH (e.g., minimum height of the sole portion 118). In some examples, the point-of-contact PC is vertically aligned with the geometric center CF of the strike face 106, when the golf club head 100 is in the address position on the ground plane 103. The sole height SH can be determined at various distances away from the point-of-contact PC in a direction towards the toe portion 114 (e.g., negative x-axis direction on the club head origin coordinate system 185) and in a direction towards the heel portion 112 (e.g., positive x-axis direction on the club head origin coordinate system 185). In certain examples, at a distance of about 22.5 mm heelward away from the point-of-contact PC, and parallel to the x-axis of the club head origin coordinate system 185, the sole height SH is at least 2.0 mm, such as, for example, between, and inclusive of, 2.0 mm and 2.8 mm (e.g., 2.4 mm). In some examples, at a distance of about 15 mm heelward away from the point-of-contact PC, and parallel to the x-axis of the club head origin coordinate system 185, the sole height SH is at least 0.9 mm, such as, for example, between, and inclusive of, 0.9 mm and 1.4 mm (e.g., 1.2 mm). In various examples, at a distance of about 22.5 mm heelward away from the point-of-contact PC, and parallel to the x-axis of the club head origin coordinate system 185, the sole height SH is between, and inclusive of, 12% and 22% of a Zup value of the golf club head 100. In certain examples, at a distance of about 7.5 mm toeward away from the GPIP, and along the x-axis of the club head origin coordinate system 185, the sole height SH is between, and inclusive of, 12% and 22% of the Zup value of the golf club head 100. In some examples, at a distance of about 52.5 mm toeward away from the GPIP, and along the x-axis of the club head origin coordinate system 185, the sole height SH is between, and inclusive of, 12% and 22% of the Zup value of the golf club head 100. As used herein, "about" means +/−5% of the indicated value or dimension.

Referring again to FIG. 2, because the golf club head 100 is shallow, an toe-GPIP angle θ2, defined between a line passing through the GPIP and the uppermost point UMP of the body 102, is small. In some examples, the angle θ2 is at most 40° (e.g., between, and inclusive of, 30° and 40°), at most 38° (e.g., between, and inclusive of, 32° and 38°), or at most 37° (e.g., between, and inclusive of, 33° and 37°).

Figure 6:
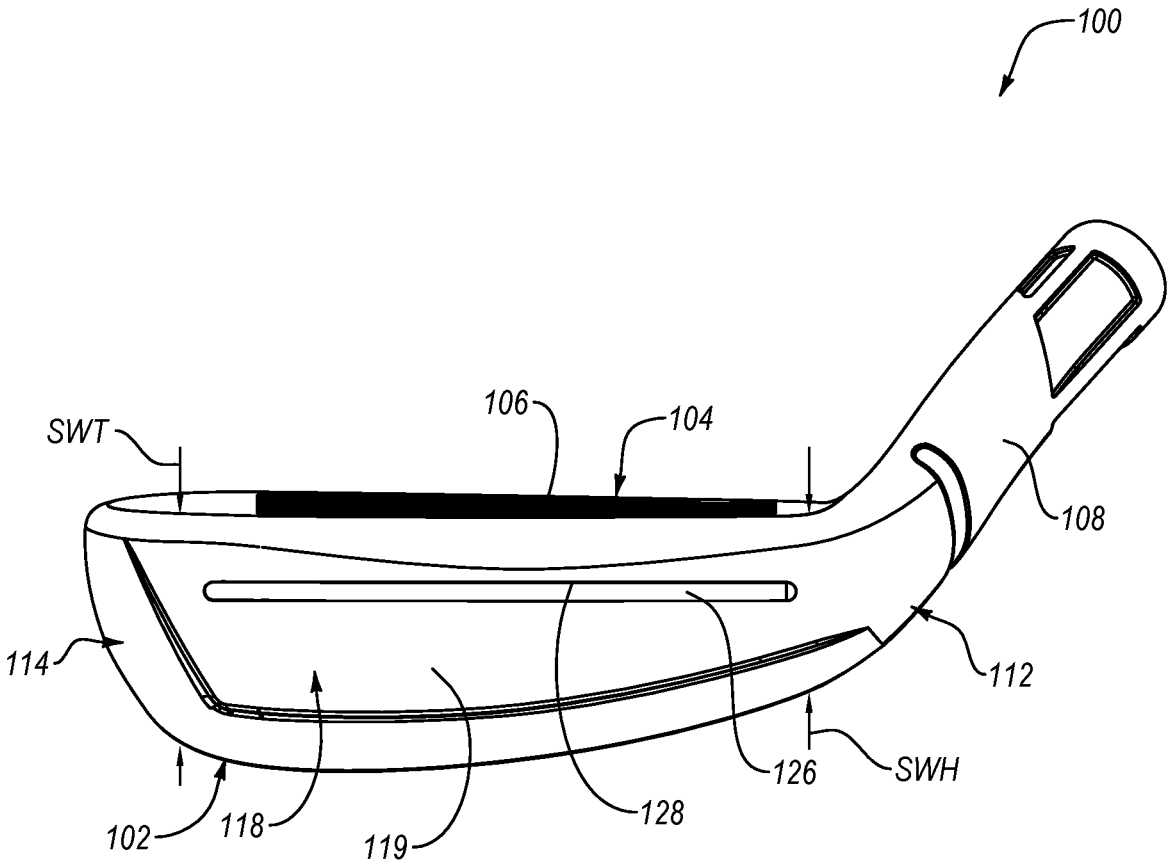
FIG. 6 is a schematic, bottom view of the golf club head of FIG. 1, according to one or more examples of the present disclosure.

Referring to FIG. 4, the golf club head 100 has a sole width SW, defined as a maximum depth of the golf club head 100. To help golfers improve their shot accuracy and shape, a lower CG can be beneficial. By widening the sole portion 118 of the golf club head 100, in a front-to-back direction, more mass is located closer to the bottom of the golf club head 100, and thus the CG of the golf club head 100 is lower. In some examples, the sole width SW is at least 30 mm (e.g., between, and inclusive of, 30 mm and 37 mm, is at least 32 mm (e.g., between, and inclusive of, 32 mm and 36 mm, or at least 33 mm (e.g., between, and inclusive of 33 mm and 36 mm). In some examples, a ratio of the maximum toe height TH to the sole width SW is at most 1.67 (e.g., between, and inclusive of, 0.95 and 1.67), at most 1.53 (e.g., between, and inclusive of, 1.06 and 1.53), or at most 1.45 (e.g., between, and inclusive of, 1.25 and 1.45). According to some examples, the width of the sole 119 at the toe portion 114 (e.g., toe sole width SWT) is greater than the width of the sole 119 at the heel portion 112 (e.g., heel sole width SWH) (see, e.g., FIG. 6). In one example, a ratio of the toe sole width SWT to the heel sole width SWH is between, and inclusive of, 1.25 and 1.65, between, and inclusive of, 1.3 and 1.5, or between, and inclusive of, 1.33 and 1.48.

Referring to FIG. 4, a height of the leading edge LEH, which is defined as the distance from the ground plane 103 to the leading edge 109 of the golf club head 100 when the golf club head 100 is in the address position, is between, and inclusive of, 2.5 mm and 6.5 mm, between, and inclusive of, 2.7 mm and 6.2 mm, or between, and inclusive of, 2.7 mm and 3.5 mm.

The sole width SW is one of several properties of the golf club head 100 that affects the position of the CG of the golf club head 100. The lowness or highness of the CG (e.g., the vertical location of the CG) is known as the Zup of the golf club head 100 (see, e.g., FIG. 4). The Zup of the golf club head 100 is the vertical distance between the CG of the golf club head 100 and the ground plane 103 when the golf club head 100 is on the ground plane 103 in the address position. In some examples, the Zup of the golf club head 100 is at least 13 mm and at most 20 mm. According to other examples, the Zup of the golf club head is at least 13 mm, and at most 19 mm, at most 18 mm, at most 17 mm, or at most 16 mm. In certain examples, the Zup of the golf club head is between, and inclusive of, 14 mm and 18 mm, or between, and inclusive of, 15 mm and 17 mm.

The golf club head 100 is further configured to promote distance of a golf ball struck by the golf club head 100. The distance of a golf ball struck by the golf club head 100 is proportional to the coefficient of restitution (COR) of the golf club head 100. The COR of the golf club head 100 is measured according to the United States Golf Association (USGA) rules set forth in the Procedure for Measuring the Velocity Ratio of a Club Head for Conformance to Rule 4-1e, Appendix II Revision 2 Feb. 8, 1999, herein incorporated by reference in its entirety. Generally, the COR values provided here are values for COR taken at a balancing point on the strike face 106, which is the point at which the golf club head 100, without being coupled to a shaft, balances. Table 1 below provides examples of the COR change relative to a calibration plate for multiple club heads of the construction of the golf club head 100, as shown in FIG. 1. The calibration plate dimensions and weight are described in section 4.0 of the Procedure for Measuring the Velocity Ratio of a Club Head for Conformance to Rule 4-1e. The values for the COR listed in Table 1 are described in terms of a difference in the COR (i.e., COR difference value or COR drop-off value) relative to the COR of a calibration plate (i.e., COR base value). In one example, the calibration plate has a COR base value of 0.831. Accordingly, the COR of the golf club head 100 is equal to the COR difference value plus the COR base value. As an example, where the golf club head 100 has a COR difference value of −0.012, the COR of the golf club head 100 would be equal to 0.819 (i.e., −0.012+0.831). Methods, techniques, and processes for testing the COR of golf club heads can be found in U.S. Pat. No. 9,597,562, issued Mar. 21, 2017, which is incorporated herein by reference in its entirety.

TABLE 1

| Example | COR Difference | COR | CT (μs) | Zup (mm) | CGx (mm) | Ixx | Izz |
|---|---|---|---|---|---|---|---|
| 1 | −0.010 | 0.821 | 247 | 15.5 | 0.1 | 45.68 | 222.07 |
| 2 | −0.009 | 0.822 | 245 | 16 | 0.1 | 47.14 | 223.53 |
| 3 | −0.010 | 0.821 | 246 | 16.3 | −0.2 | 46.23 | 223.86 |
| 4 | −0.010 | 0.821 | 249 | — | — | — | — |
| 5 | −0.012 | 0.819 | 246 | — | — | — | — |
| 6 | −0.012 | 0.819 | 262 | 16.2 | 0.8 | 48.8 | 235.2 |
| 7 | −0.007 | 0.824 | 267 | 17.7 | −0.1 | 47.5 | 233.8 |
| 8 | −0.012 | 0.819 | 250 | 16.4 | 0.3 | 49 | 235.6 |

TABLE 1-continued

| Example | COR Difference | COR | CT (μs) | Zup (mm) | CGx (mm) | Ixx | Izz |
|---|---|---|---|---|---|---|---|
| 9 | −0.013 | 0.818 | 263 | — | — | — | — |
| 10 | −0.011 | 0.820 | 254 | — | — | — | — |
| 11 | −0.007 | 0.824 | 258 | 16.8 | 0.9 | 47.7 | 233.1 |
| 12 | −0.007 | 0.824 | 255 | 15.9 | 0.3 | 46.7 | 232.1 |
| 13 | −0.007 | 0.824 | 256 | 17.5 | −0.7 | 46.6 | 232.3 |
| 14 | −0.008 | 0.823 | 264 | — | — | — | — |
| 15 | −0.006 | 0.825 | 258 | — | — | — | — |
| 16 | −0.006 | 0.825 | 274 | 15.5 | 0.5 | 46.21 | 219.78 |
| 17 | −0.009 | 0.822 | 285 | 15.7 | 0.7 | 46.16 | 222.51 |
| 18 | −0.009 | 0.822 | 276 | 15.5 | 0.8 | 45.29 | 220 |
| 19 | −0.005 | 0.826 | 271 | — | — | — | — |
| 20 | −0.006 | 0.825 | 277 | — | — | — | — |
| 21 | −0.008 | 0.823 | 286 | — | — | — | — |
| 22 | −0.010 | 0.821 | 280 | — | — | — | — |
| 23 | −0.010 | 0.821 | 275 | — | — | — | — |
| 24 | −0.006 | 0.825 | 292 | — | — | — | — |
| 25 | −0.004 | 0.827 | 277 | — | — | — | — |
| 26 | −0.006 | 0.825 | 254 | 15.6 | 0.4 | 46.08 | 232.14 |
| 27 | −0.006 | 0.825 | 252 | 16.6 | −0.5 | 47.35 | 234.44 |
| 28 | −0.009 | 0.822 | 246 | 15.9 | −0.1 | 46.63 | 231.91 |
| 29 | −0.009 | 0.822 | 263 | — | — | — | — |
| 30 | −0.005 | 0.826 | 272 | 14.2 | −0.8 | 44.3 | 230.2 |
| 31 | −0.005 | 0.826 | 286 | 15.2 | −0.3 | 44.1 | 227.8 |
| 32 | −0.001 | 0.830 | 295 | 15.3 | 0.8 | 44 | 227.3 |
| 33 | −0.009 | 0.822 | 283 | — | — | — | — |

CGx refers to the location of the CG of the golf club head 100 relative to a coordinate system (with an x-axis parallel to the x-axis of the club head origin coordinate system 185) centered on the strike face 106 at a midpoint of the grooves 107 of the golf club head 100. Ixx and Izz refer to the moment of inertia about an x-axis and a z-axis of a coordinate system (with an x-axis, y-axis, and z-axis parallel to the x-axis, y-axis, and z-axis, respectively, of the club head origin coordinate system 185), respectively, and have units of kg*mm^2.

In some examples, the COR of the golf club head 100 is at most 0.830 (e.g., a COR difference value not greater than −0.001), and at least 0.818 (e.g., a COR difference value not lesser than −0.013), at least 0.820 (e.g., a COR difference value not lesser than −0.011), at least 0.822 (e.g., a COR difference value not lesser than −0.009) at least 0.824 (e.g., a COR difference value not lesser than −0.007), or at least 0.826 (e.g., a COR difference value not lesser than −0.005). Because the golf club head 100 is configured to have a relatively high COR, according to certain examples, a value of the maximum toe height TH divided by the COR is no more than 62 mm (e.g., between, and inclusive of, 42 mm and 62 mm), no more than 55 mm (e.g., between, and inclusive of, 42 mm and 55 mm), no more than 50 mm (e.g., between, and inclusive of, 42 mm and 50 mm), or no more than 45 mm (e.g., between, and inclusive of, 42 mm and 45 mm).

Analogously, because the golf club head 100 is configured to have a relative high COR and a relatively low Zup value, a value of the COR divided by the Zup value is high. In some examples, the value of the COR divided by the Zup value is at most 0.060 per mm, and at least 0.040 per mm, at least 0.045 per mm, or at least 0.050 per mm, or at least 0.055 per mm.

In some examples, the COR is dependent on the thickness profile of the front portion 104 at the strike face 106. Moreover, the thickness profile can affect the bias of the golf club head 100, such as creating a draw bias, which can help golfers close the face (rotate the golf club head 100) during a golf swing to put a draw spin on the golf ball. In some examples, the thickness of the front portion 104 at the strike face 106 is variable, such that the golf club head 100 has a variable thickness profile. Moreover, the variable thickness profile of the golf club head 100 is such that a maximum thickness of the front portion 104 at the strike face 106 is toeward of the CF of the strike face 106 (e.g., at least 50 mm, 55 mm, 60 mm, or 65 mm toeward of the GPIP along an axis parallel to the x-axis of the club head origin coordinate system 185). Additionally, the thickness T3 of the front portion 104 at the CF is less than the maximum thickness of the front portion 104. In certain examples, the thickness T3 of the front portion 104 increases from the CF to the maximum thickness at the toeward location of the CF. In certain examples, the maximum thickness of the front portion 104 at the strike face 106 is between, and inclusive of, 3.05 mm and 3.75 mm, between, and inclusive of, 3.1 mm and 4.2 mm, or between, and inclusive of, 2.65 mm and 3.3 mm. In contrast, a minimum thickness of the front portion 104 at the strike face 106 is between, and inclusive of, 1.34 mm and 1.85 mm, between, and inclusive of, 1.45 mm and 2.5 mm, or between, and inclusive of, 0.9 mm and 1.45 mm. The maximum thickness of the front portion 104 at the CF is between, and inclusive of, 2.65 mm and 3.45 mm, between, and inclusive of, 2.65 mm and 3.3 mm, between, and inclusive of, 2.85 mm and 3.45 mm, or between, and inclusive of, 2.4 mm and 2.9 mm. Accordingly, in certain examples, a ratio of the maximum thickness of the front portion 104, along the strike face 106, to the thickness of the front portion 104, at the geometric center CF of the strike face 106, is between, and inclusive of, 1.1 mm and 1.75 mm.

Figure 9:
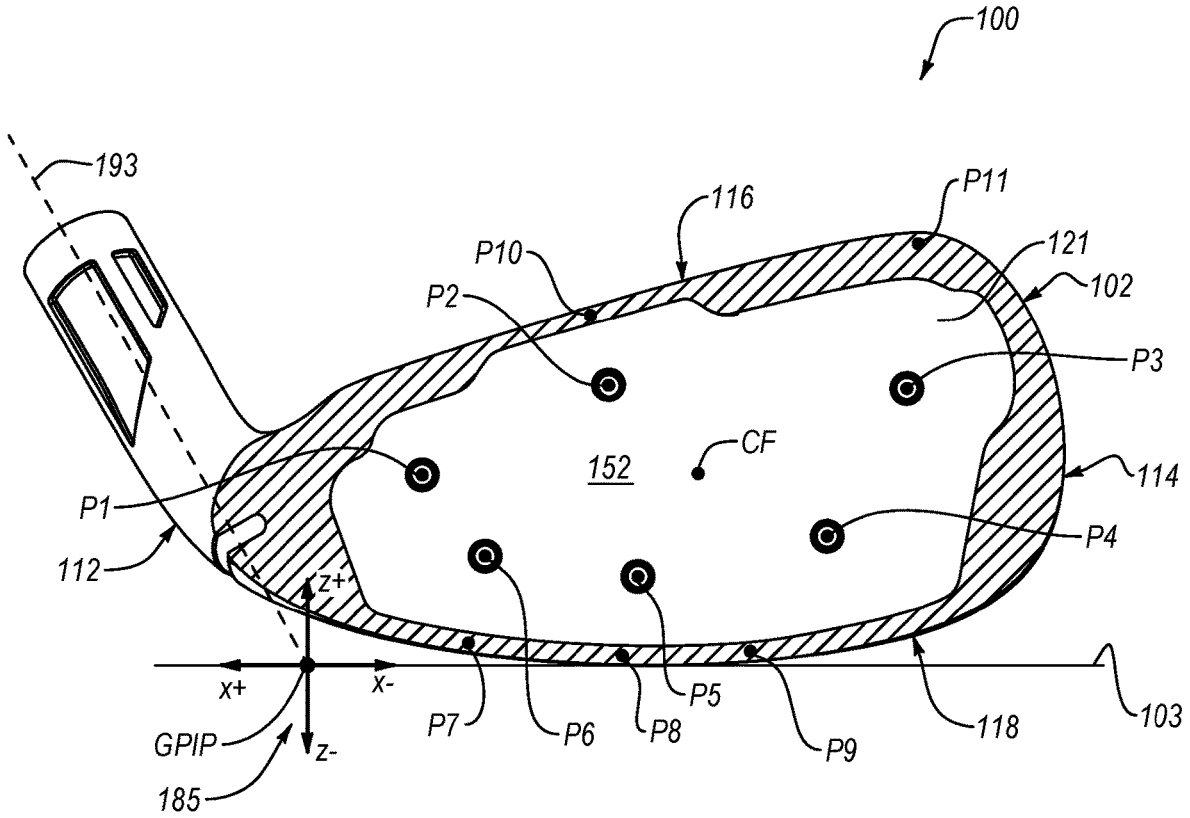
FIG. 9 is a schematic, sectional, rear view of the golf club head of FIG. 1, taken along the line 9-9 of FIG. 5, according to one or more examples of the present disclosure.

Referring now to FIG. 9, the variable thickness profile of the front portion 104 along the strike face 106 is represented by providing the thickness of the front portion 104 at various points (i.e., P1-P6) on the strike face 106. For comparison, a thickness T1 of the golf club head 100 at various points (i.e., P7-P9) along the top-line portion 116, adjacent the front portion 104, and a thickness T2 of the golf club head 100 at various points (i.e., P10 and P11) along the sole portion 118, adjacent the front portion 104 is also represented. The location of the points P1-P6 on the strike face 106 (for at least Examples 1-4 of Table 3 below) is identified by the x-coordinate (in millimeters) and y-coordinate (in millimeters) of the points on the club head origin coordinate system 185, as shown in Table 2 below. For examples 5-9 of Table 3, in certain instances, point P1 is generally heelward and upward of center face, point P2 is generally upward of center face and more toeward than point P1, point P3 is generally upward of center face and more toeward than point P3, point P4 is generally lower than and toeward of center face, point P5 is generally lower than center face and heelward of point P4, and point P6 is generally lower than center face and heelward of point P5. The points P7-P9 along the sole portion 118 are points within a heelward section, a central section, and a toeward section of the sole portion 118, respectively. Similarly, the points P10 and P11 along the top-line portion 116 are points within a central section and a toeward section of the top-line portion 116, respectively. Table 3 provided below includes thickness values (in millimeters (mm)) for the points illustrated in FIG. 9, with each thickness value having a tolerance of +−0.15 mm, for several examples of the golf club head 100.

TABLE 2

| | P1 | P2 | P3 | P4 | P5 | P6 |
|---|---|---|---|---|---|---|
| x-axis | −10.7 | −31.1 | −64.0 | −55.1 | −33.7 | −19.0 |
| y-axis | 20.4 | 28.8 | 27.7 | 13.5 | 8.7 | 11.8 |

TABLE 3

| Example | P1 | P2 | P3 | P4 | P5 | P6 | P7 | P8 | P9 | P10 | P11 |
|---|---|---|---|---|---|---|---|---|---|---|---|
| 1 | 1.63 | 1.72 | 3.01 | 3.25 | 2.33 | 1.64 | 2.20 | 2.20 | 2.20 | 1.0 | 1.0 |
| 2 | 1.63 | 1.71 | 3.00 | 3.25 | 2.35 | 1.64 | 2.20 | 2.20 | 2.20 | 1.0 | 1.0 |
| 3 | 1.60 | 1.72 | 3.45 | 3.45 | 1.87 | 1.60 | 2.20 | 2.20 | 2.20 | 1.0 | — |
| 4 | 1.70 | 1.78 | 3.55 | 3.55 | 1.98 | 1.70 | 2.20 | 2.20 | 2.20 | 1.5 | — |
| 5 | 1.8 | 3.51 | 3.65 | 3.65 | 2.03 | 1.8 | — | — | — | 1.5 | — |
| 6 | 1.9 | 1.96 | 3.75 | 3.75 | 3.67 | 1.9 | — | — | — | — | — |
| 7 | 2.0 | 2.11 | 3.85 | 3.85 | 3.74 | 2.0 | — | — | — | — | — |
| 8 | 2.1 | 2.45 | 3.69 | 3.95 | 3.65 | 2.11 | — | — | — | — | — |
| 9 | 2.2 | 2.73 | 3.46 | 4.05 | 2.76 | 2.21 | — | — | — | — | — |

The COR of the golf club head 100 is related to a characteristic time CT of the golf club head 100. In some examples, a maximum CT of the golf club head 100 is located at the geometric center or center face CF of the strike face 106. In certain examples, the maximum CT of the golf club head 100 is between, and inclusive of, 310 microseconds and 330 microseconds (e.g., around 318 microseconds). A difference between the maximum CT of the golf club head 100 and the CT at a location on the strike face 106, which is (1) within a vertical plane passing through the geometric center CF and perpendicular to the grooves 107 and (2) between the first and second grooves 107 closest to the sole 119, is no more than 110 microseconds, such as, for example, between, and inclusive of, 30 microseconds and 90 microseconds, or between, and inclusive of, 40 microseconds and 80 microseconds. Methods of determining the CT of the golf club head 100 at any of various points on the strike face 106 are disclosed in U.S. Pat. No. 10,188,915, issued Jan. 29, 2019, which is incorporated herein by reference in its entirety.

Referring to FIG. 10, and according to the chart 200, various characteristics (and their associated values) similar to or in addition to the characteristics of the examples of the golf club head 100 disclosed above are shown. The examples listed in the chart 200 correspond to the examples listed in Table 3 above. The values for Ixx and Izz have dimensions of kg*mm^2.

In some examples, the volume of the golf club head 100 is between about 10 $cm^3$ and about 120 $cm^3$. For example, in some embodiments, the golf club head 100 has a volume between about 20 $cm^3$ and about 110 $cm^3$, such as between about 30 $cm^3$ and about 100 $cm^3$, such as between about 40 $cm^3$ and about 90 $cm^3$, such as between about 50 $cm^3$ and about 80 $cm^3$, and such as between about 60 $cm^3$ and about 80 $cm^3$.

In certain implementations, the golf club head 100 includes removable shaft features similar to those described in more detail in U.S. Pat. No. 8,303,431, the contents of which are incorporated by reference herein in in their entirety.

According to yet some implementations, the golf club head 100 includes adjustable loft/lie features similar to those described in more detail in U.S. Pat. Nos. 8,025,587; 8,235,831; 8,337,319; U.S. Patent Application Publication No. 2011/0312437A1; U.S. Patent Application Publication No. 2012/0258818A1; U.S. Patent Application Publication No. 2012/0122601A1; U.S. Patent Application Publication No. 2012/0071264A1; and U.S. patent application Ser. No. 13/686,677, the entire contents of which are incorporated by reference herein in their entirety.

Additionally, in some implementations, the golf club head 100 includes adjustable sole features similar to those described in more detail in U.S. Pat. No. 8,337,319; U.S. Patent Application Publication Nos. 2011/0152000A1, 2011/0312437, 2012/0122601A1; and U.S. patent application Ser. No. 13/686,677, the entire contents of each of which are incorporated by reference herein in their entirety.

In some implementations, the golf club head 100 includes composite face portion features similar to those described in more detail in U.S. patent application Ser. Nos. 11/998,435; 11/642,310; 11/825,138; 11/823,638; 12/004,386; 12/004,387; 11/960,609; 11/960,610; and U.S. Pat. No. 7,267,620, which are herein incorporated by reference in their entirety.

In some examples, the golf club heads disclosed herein can have one or more of the features disclosed in U.S. Patent Application Publication No. 2018/0185717, published Jul. 5, 2018.

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, can be defined to mean within +/−5% of a given value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the examples below are to be embraced within their scope.

What is claimed is:

1. An iron-type golf club head, comprising:

a body, comprising a heel portion, a sole portion defining a sole of the iron-type golf club head, a toe portion, a top-line portion, a front portion, which comprises a strike face, and a rear portion;

wherein:

a ratio of a maximum toe height of the iron-type golf club head to a blade length of the iron-type golf club head is greater than zero and at most 0.62;

wherein the maximum toe height is no more than 52 millimeters (mm);

a ratio of the maximum toe height to a maximum heel height of the iron-type golf club head is between, and inclusive of, 1.4 and 1.55;

the maximum heel height is no less than 25 mm;

a maximum thickness of the front portion, along the strike face, corresponds with a location toeward of a geometric center of the strike face;

a thickness of the front portion, at the geometric center of the strike face, is less than the maximum thickness of the front portion;

a coefficient of restitution (COR) of the iron-type golf club head is at least 0.818 and at most 0.830;

a Zup value of a center-of-gravity of the iron-type golf club head is at most between, and inclusive of, 13 mm and 19 mm; and an entirety of the sole is rounded along a plane parallel to the strike face, and a radius of curvature of the sole, along the plane parallel to the strike face, is no more than between, and inclusive of, 100 mm and 275 mm.

2. The iron-type golf club head according to claim 1, wherein a ratio of the maximum toe height of the iron-type golf club head to a maximum width of the sole of the iron-type golf club head is greater than zero and at most 1.67.

3. The iron-type golf club head according to claim 2, wherein the maximum width of the iron-type golf club head is between, and inclusive of, 29 mm and 32 mm.

4. The iron-type golf club head according to claim 1, wherein:

an angle defined between a line, passing through a ground plane intersection point and a location on the iron-type golf club head corresponding with the maximum toe height, and the ground plane is at most 38°; and the ground plane intersection point is defined as a point at which a hosel axis of the iron-type golf club head intersects a ground plane when the iron-type golf club head is in a proper address position on the ground plane.

5. The iron-type golf club head according to claim 1, wherein a value of the maximum toe height of the iron-type golf club head divided by the COR of the iron-type golf club head is more than zero mm and no more than 62 mm.

6. The iron-type golf club head according to claim 1, wherein a value of the COR of the iron-type golf club head divided by the Zup value of the center-of-gravity of the iron-type golf club head is at most 0.060 per mm and at least 0.040 per mm.

7. The iron-type golf club head according to claim 6, wherein the Zup value of the center-of-gravity of the iron-type golf club head is between, and inclusive of, 16 mm and 19 mm.

8. The iron-type golf club head according to claim 1, wherein the blade length is between, and inclusive of, 80 mm and 84 mm.

9. The iron-type golf club head according to claim 1, wherein the maximum toe height is between, and inclusive of, 35 mm and 40 mm.

10. The iron-type golf club head according to claim 1, wherein:

the thickness of the front portion is variable along the strike face; and the thickness of the front portion, along the strike face, increases from the geometric center of the strike face to the location toeward of the geometric center of the strike face.

11. The iron-type golf club head according to claim 10, wherein the maximum thickness of the front portion, along the strike face, is between, and inclusive of, 3.05 mm and 3.75 mm.

12. The iron-type golf club head according to claim 11, wherein a minimum thickness of the front portion, along the strike face, is between, and inclusive of, 1.35 mm and 1.85 mm.

13. The iron-type golf club head according to claim 11, wherein the thickness of the front portion, at the geometric center of the strike face, is between, and inclusive of, 2.65 mm and 3.45 mm.

14. The iron-type golf club head according to claim 10, wherein the location corresponding with the maximum thickness of the front portion is at least 50 mm toeward of a ground plane intersection point of the iron-type golf club head.

15. The iron-type golf club head according to claim 10, wherein a ratio of the maximum thickness of the front portion, along the strike face, to the thickness of the front portion, at the geometric center of the strike face, is between, and inclusive of, 1.1 mm and 1.75 mm.

16. The iron-type golf club head according to claim 1, wherein, when the iron-type golf club head is in an address position on a ground plane, a minimum height of the sole portion away from the ground plane, at a distance of about 15 mm heelward away from a point-of-contact of the sole with the ground plane, is between, and inclusive of, 0.9 mm and 1.4 mm.

17. The iron-type golf club head according to claim 1, wherein, when the iron-type golf club head is in an address position on a ground plane, a minimum height of the sole portion away from the ground plane, at a distance of about 22.5 mm heelward away from a point-of-contact of the sole with the ground plane, is between, and inclusive of, 12% and 22% of the Zup value of the iron-type golf club head.

18. The iron-type golf club head according to claim 1, wherein, when the iron-type golf club head is in an address position on a ground plane, a minimum height of the sole portion away from the ground plane, at a distance of about 7.5 mm toeward of a ground plane intersection point of the iron-type golf club head, is between, and inclusive of, 12% and 22% of the Zup value of the iron-type golf club head.

19. The iron-type golf club head according to claim 1, further comprising:

an internal cavity defined between the heel portion, the sole portion, the toe portion, the top-line portion, the front portion, and the rear portion; and an internal damper within the internal cavity, in contact with an internal surface of the front portion, opposite the strike face, and in contact with an internal surface of the rear portion;

wherein the internal damper has a hardness less than a hardness of the front portion of the body.

20. The iron-type golf club head according to claim 19, wherein:

the internal damper comprises a pocket; and the iron-type golf club head further comprises an internal stiffener within the pocket;

wherein a hardness of the internal stiffener is less than the hardness of the internal damper and less than the hardness of the front portion of the body.

21. The iron-type golf club head according to claim 20, wherein:

the body of the iron-type golf club head is made of a metallic material; and each one of the internal damper and the internal stiffener is made of a polymeric material.

22. The iron-type golf club head according to claim 20, wherein an entirety of the pocket is toeward of a geometric center of the strike face.

23. The iron-type golf club head according to claim 22, wherein the pocket faces the top-line portion of the body and is open to the internal cavity.

24. The iron-type golf club head according to claim 20, wherein the pocket is interposed between and spaced apart from the internal surface of the front portion and the internal surface of the rear portion so that no part of the internal stiffener is in contact with the internal surface of the front portion and the internal surface of the rear portion.

25. The iron-type golf club head according to claim 20, wherein a front-to-rear dimension of the internal damper, the pocket, and the internal stiffener increases in a direction from the heel portion to the toe portion.

26. The iron-type golf club head according to claim 20, wherein the internal cavity comprises an unfilled portion.

27. The iron-type golf club head according to claim 1, further comprising an internal cavity defined between the heel portion, the sole portion, the toe portion, the top-line portion, the front portion, and the rear portion, wherein the rear portion comprises:

an opening; and a badge covering the opening.

28. The iron-type golf club head according to claim 1, wherein:

the sole portion comprises a sole slot extending lengthwise in a heel-to-toe direction; and the iron-type golf club head further comprises a filler material within the sole slot.

29. The iron-type golf club head according to claim 28, wherein the sole slot extends from a sole of the iron-type golf club head toward the top-line portion at an angle relative to the strike face of the front portion.

30. The iron-type golf club head according to claim 1, wherein the iron-type golf club head has a loft between 20 degrees and 34 degrees when the iron-type golf club head is in an address position on a ground plane.

31. The iron-type golf club head according to claim 1, wherein the strike face is flat in a heel-to-toe direction.

32. The iron-type golf club head according to claim 1, wherein a ratio of a width of the sole at the toe portion to a width of the sole at the heel portion is between, and inclusive of, 1.3 and 1.5.

33. The iron-type golf club head according to claim 1, wherein a difference between a maximum characteristic time of the golf club head and a characteristic time at a location on the strike face, which is within a plane passing through the geometric center of the strike face and perpendicular to grooves formed in the strike face, and between first and second ones of the grooves closest to the sole, is between, and inclusive of, 30 microseconds and 90 microseconds.

34. An iron-type golf club head, comprising:

a body, comprising a heel portion, a sole portion, a toe portion, a top-line portion, a front portion, which comprises a strike face, and a rear portion;

wherein:

a coefficient of restitution (COR) difference value, equal to a difference between a measured COR of the golf club head and a COR-testing calibration plate, is not lesser than −0.013;

a ratio of a maximum toe height of the iron-type golf club head to a blade length of the iron-type golf club head is greater than zero and at most 0.62;

a ratio of the maximum toe height of the iron-type golf club head to a maximum depth of the iron-type golf club head is greater than zero and at most 1.67;

a value of the maximum toe height of the iron-type golf club head divided by the COR of the iron-type golf club head is more than zero and no more than 62 millimeters (mm);

a value of the COR of the iron-type golf club head divided by a Zup value of a center-of-gravity of the iron-type golf club head is at most 0.060 per mm and least 0.040 per mm;

a maximum thickness of the front portion, along the strike face, corresponds with a location toeward of a geometric center of the strike face; and a ratio of the maximum toe height to a radius of curvature of the sole portion, along a plane parallel to the strike face, is between, and inclusive of, 0.24 and 0.34.

35. An iron-type golf club head, comprising:

a body, comprising a heel portion, a sole portion defining a sole of the iron-type golf club head, a toe portion, a top-line portion, a front portion, which comprises a strike face, and a rear portion;

wherein:

an angle defined between a line, passing through a ground plane intersection point and a location on the iron-type golf club head corresponding with a maximum toe height of the iron-type golf club head, and the ground plane is at most 38°;

the ground plane intersection point is defined as a point at which a hosel axis of the iron-type golf club head intersects the ground plane when the iron-type golf club head is in a proper address position on the ground plane; and an entirety of the sole is rounded along a plane parallel to the strike face, and a radius of curvature of the sole, along the plane parallel to the strike face, is no more than between, and inclusive of, 100 millimeters (mm) and 275 mm.

* * * * *